US010657868B2

(12) United States Patent
Biwa et al.

(10) Patent No.: US 10,657,868 B2
(45) Date of Patent: May 19, 2020

(54) DISPLAY APPARATUS AND CORRECTION METHOD

(71) Applicant: Sony Semiconductor Solutions Corporation, Kanagawa (JP)

(72) Inventors: Goshi Biwa, Kanagawa (JP); Norifumi Kikuchi, Kanagawa (JP); Ippei Nishinaka, Kanagawa (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 0 days.

(21) Appl. No.: 15/554,888

(22) PCT Filed: Feb. 16, 2016

(86) PCT No.: PCT/JP2016/000791
§ 371 (c)(1),
(2) Date: Aug. 31, 2017

(87) PCT Pub. No.: WO2016/147552
PCT Pub. Date: Sep. 22, 2016

(65) Prior Publication Data

US 2018/0047325 A1 Feb. 15, 2018

(30) Foreign Application Priority Data

Mar. 17, 2015 (JP) ..... 2015-053462

(51) Int. Cl.
*G09G 3/20* (2006.01)
*G09G 3/32* (2016.01)
*G09G 5/02* (2006.01)

(52) U.S. Cl.
CPC ..... *G09G 3/2003* (2013.01); *G09G 3/32* (2013.01); *G09G 5/02* (2013.01);
(Continued)

(58) Field of Classification Search
CPC ..... G09G 3/2003; G09G 3/32; G09G 2320/0693; G09G 2320/0666;
(Continued)

(56) References Cited

U.S. PATENT DOCUMENTS 6,097,367 A 8/2000 Kuriwaki et al.
6,313,816 B1 * 11/2001 Kojima ..... G09G 3/32 345/690

(Continued)

FOREIGN PATENT DOCUMENTS

JP 08-272316 A 10/1996
JP 2000-155548 A 6/2000

(Continued)

OTHER PUBLICATIONS

International Search Report and Written Opinion dated Jun. 1, 2016 in connection with International Application No. PCT/JP2016/000791.

(Continued)

*Primary Examiner* — Nitin Patel
*Assistant Examiner* — Amy Onyekaba
(74) *Attorney, Agent, or Firm* — Wolf, Greenfield & Sacks, P.C.

(57) ABSTRACT

A display apparatus may comprise a display section and circuitry. The display section may comprise a plurality of display units arranged in a two-dimensional array, wherein each of the display units comprises a plurality of pixels arranged in a matrix, and each of the plurality pixels comprises a plurality of light-emitting devices that are each configured to emit a different color of light. The circuitry may be configured to generate a corrected image signal based on an uncorrected image signal and correction factors that correct luminance and chromaticity of the light-emitting devices, including at least some correction factors deter- (Continued)

mined by adjusting light emission intensity ratios of first light-emitting devices that are configured to emit light of a particular color and are disposed in different ones of the plurality of pixels.

19 Claims, 24 Drawing Sheets

(52) U.S. Cl.
CPC ..... *G09G 2300/026* (2013.01); *G09G 2300/0452* (2013.01); *G09G 2320/0242* (2013.01); *G09G 2320/0285* (2013.01); *G09G 2320/0666* (2013.01); *G09G 2320/0693* (2013.01); *G09G 2360/142* (2013.01); *G09G 2360/16* (2013.01)

(58) Field of Classification Search
CPC ..... G09G 2320/0285; G09G 2360/142; G09G 2300/0452; G09G 2300/026; G09G 5/02; G09G 2360/16; G09G 2320/0242
See application file for complete search history.

(56) References Cited

U.S. PATENT DOCUMENTS 10,001,585 B2 * 6/2018 Hayama ..... G02B 6/0035
2002/0075277 A1 * 6/2002 Naito ..... G09G 3/20 345/589
2003/0016198 A1 * 1/2003 Nagai ..... G09G 1/285 345/83
2007/0252924 A1 * 11/2007 Haga ..... G02B 5/223 349/68
2010/0321607 A1 * 12/2010 Utsumi ..... G02F 1/133514 349/61
2012/0133575 A1 * 5/2012 Hasegawa ..... H01L 51/5265 345/76
2013/0044473 A1 * 2/2013 Hattori ..... F21K 9/00 362/231
2013/0057593 A1 * 3/2013 Morishita ..... G09G 3/3413 345/690
2014/0043369 A1 2/2014 Albrecht et al.
2014/0139571 A1 5/2014 Albrecht et al.
2014/0306979 A1 10/2014 Chun et al.
2016/0181329 A1 * 6/2016 Tomizawa ..... H01L 27/3213 349/61
2017/0146856 A1 * 5/2017 Yokota ..... G02F 1/133514

FOREIGN PATENT DOCUMENTS

JP 2001-318651 A 11/2001
JP 2007-226084 A 9/2007
JP 2008-008949 A 1/2008
JP 2011-040366 A 2/2011

OTHER PUBLICATIONS

International Preliminary Report on Patentability dated Sep. 28, 2017 in connection with International Application No. PCT/JP2016/000791.

* cited by examiner

[Fig. 1]
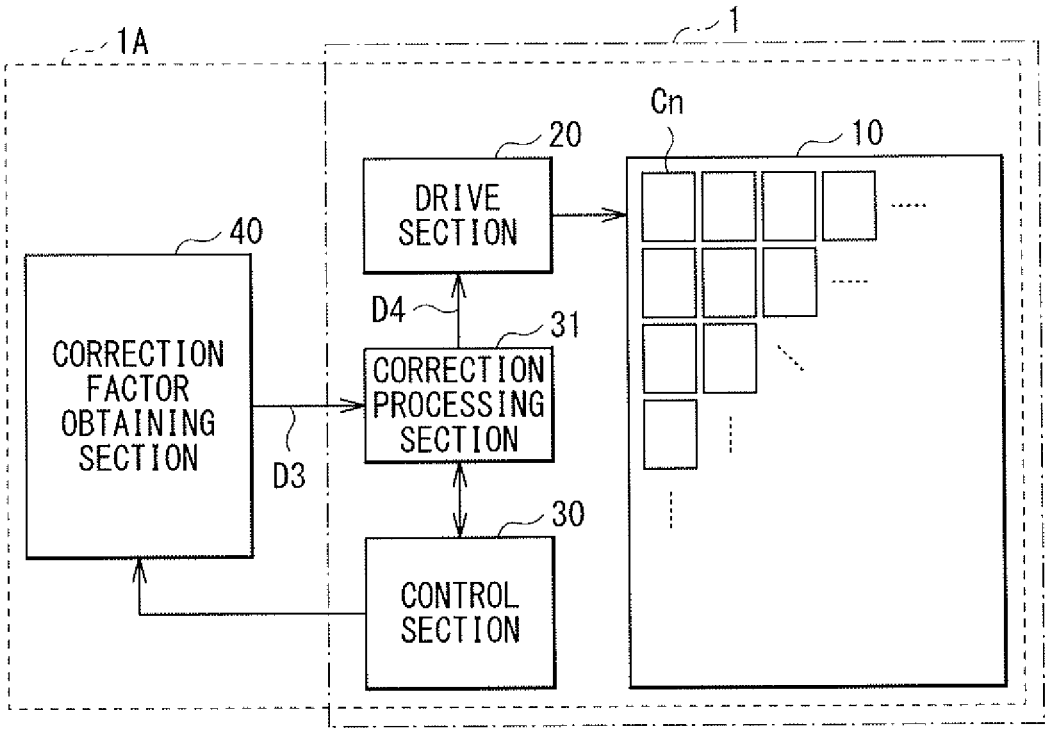
[Fig. 2]
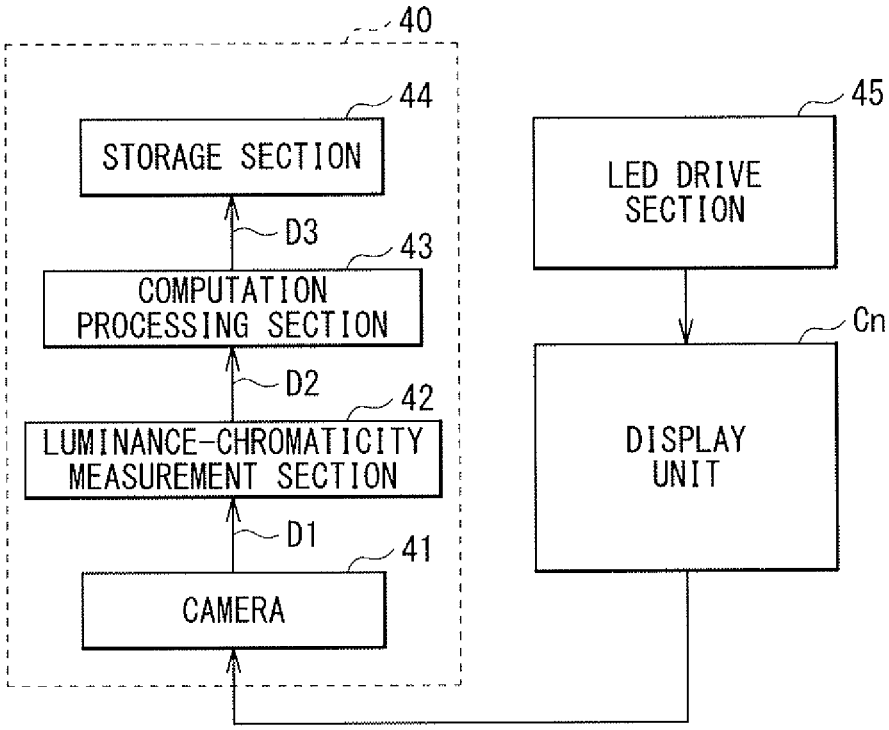

[Fig. 3]
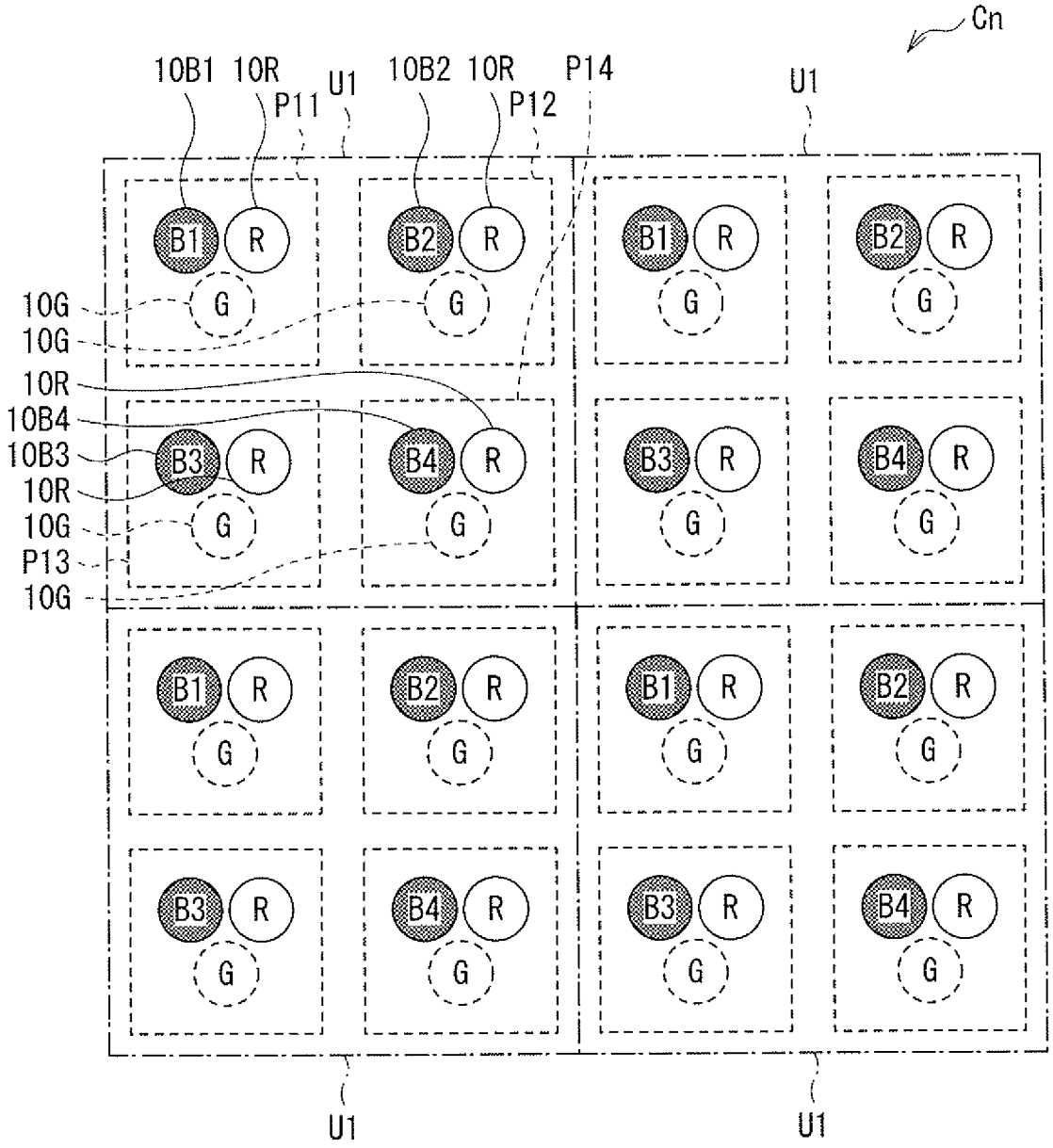

[Fig. 4]
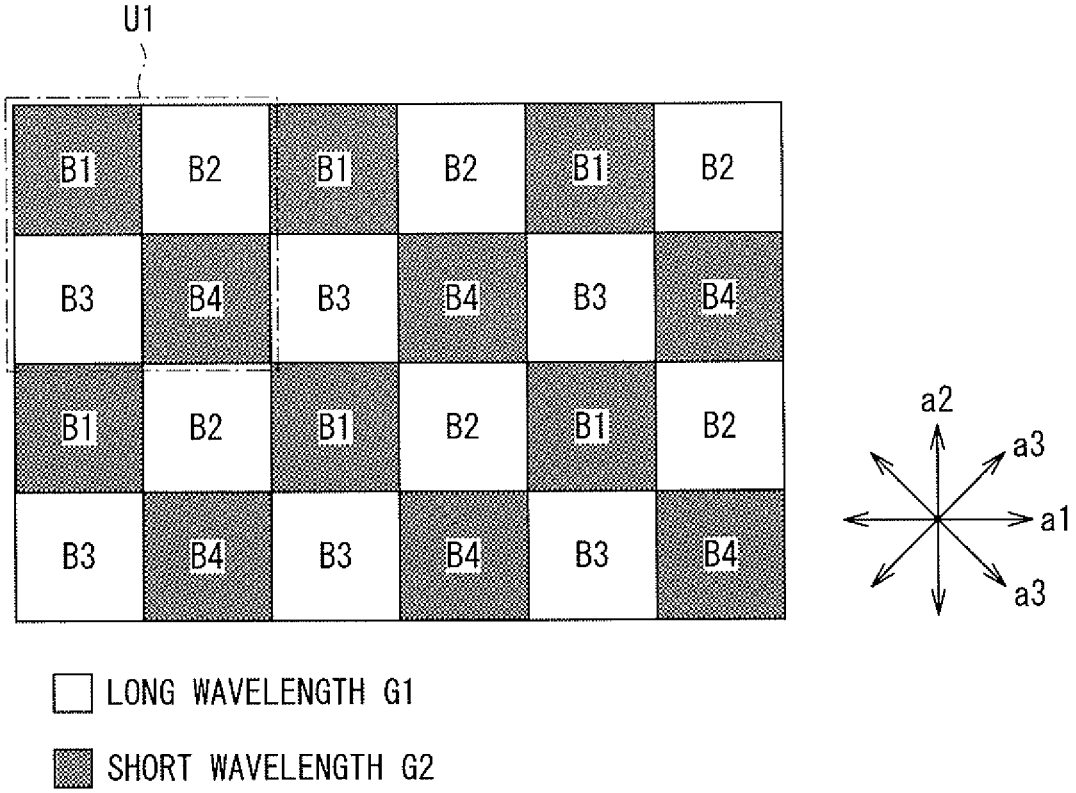

[Fig. 5]
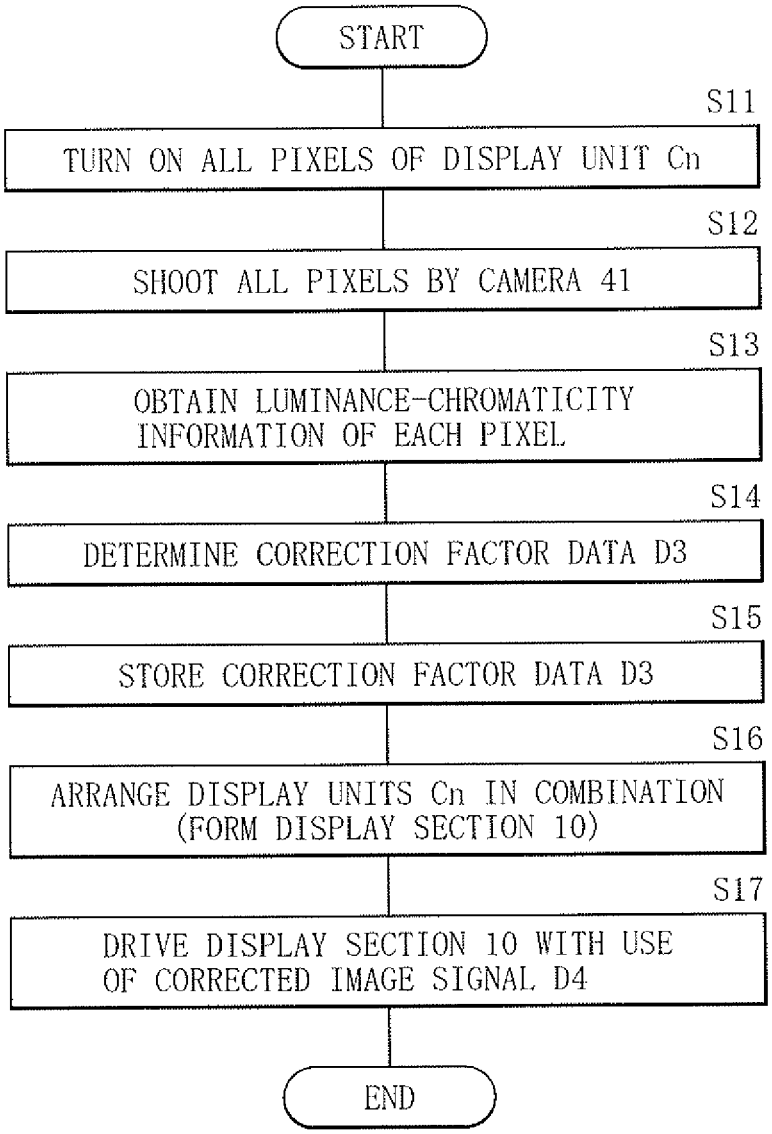

[Fig. 6]
COMPARATIVE EXAMPLE 1
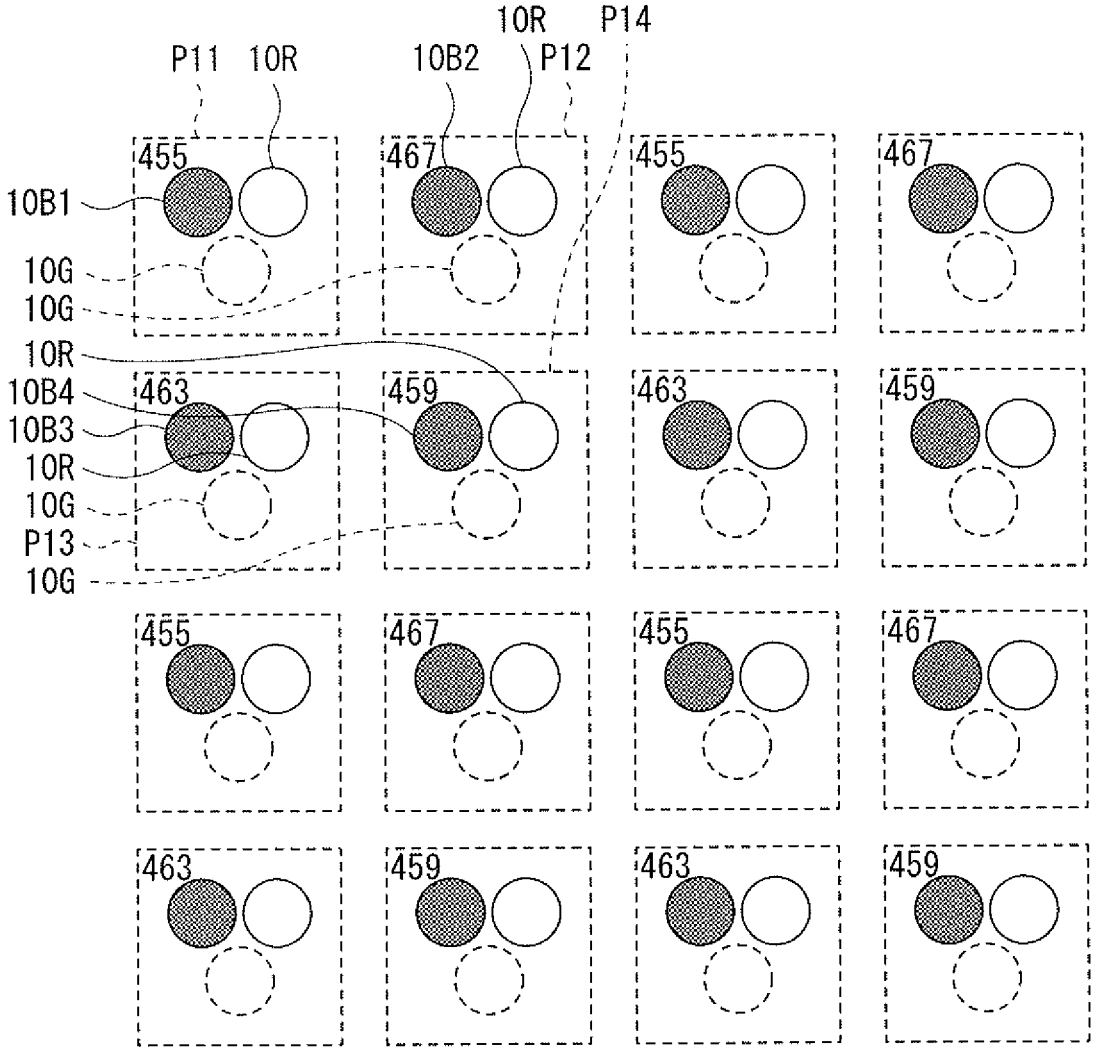

[Fig. 7A]
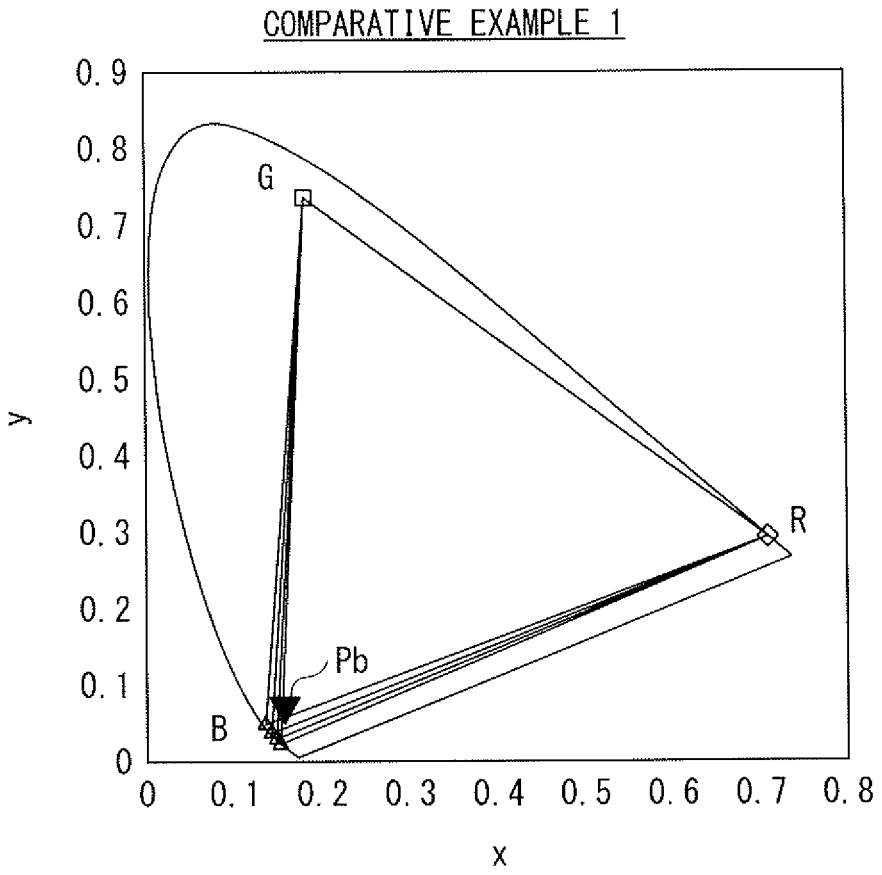
[Fig. 7B]
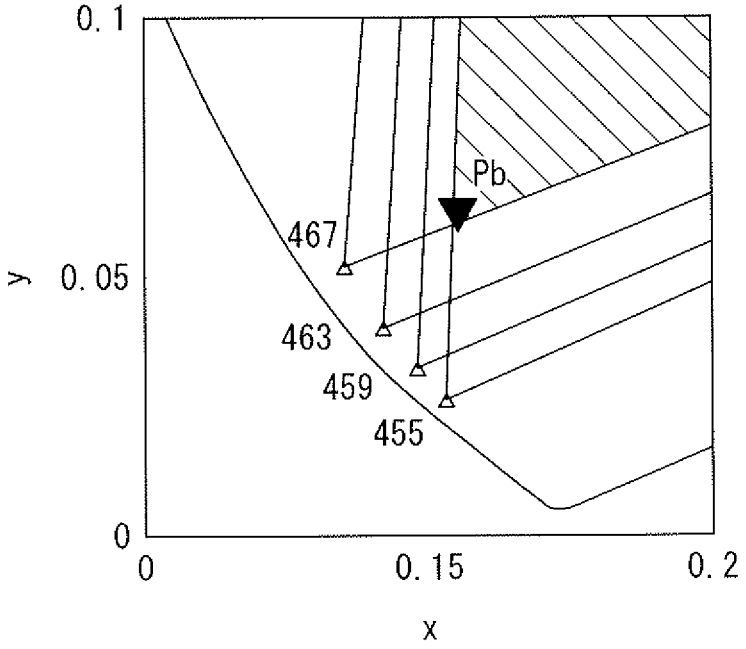

[Fig. 8]
COMPARATIVE EXAMPLE 1
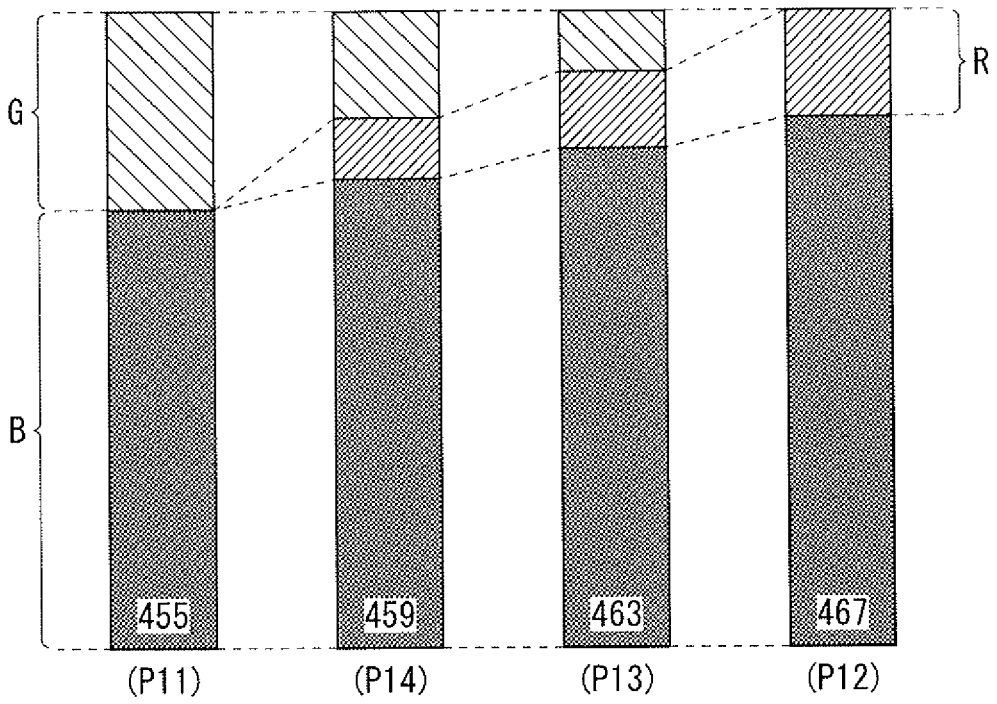
[Fig. 9]
COMPARATIVE EXAMPLE 1 (OUTSIDE CENTER OF RETINA)
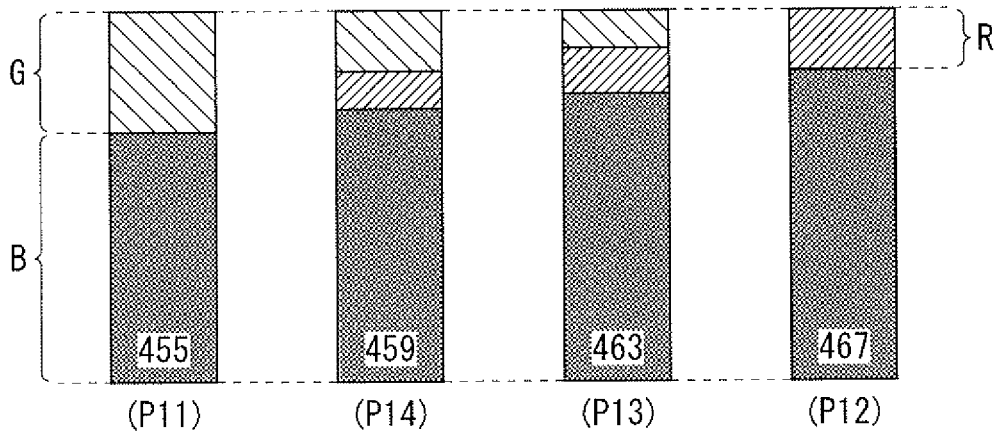

[Fig. 10]
COMPARATIVE EXAMPLE 1 (VISION OUTSIDE CENTER OF RETINA)
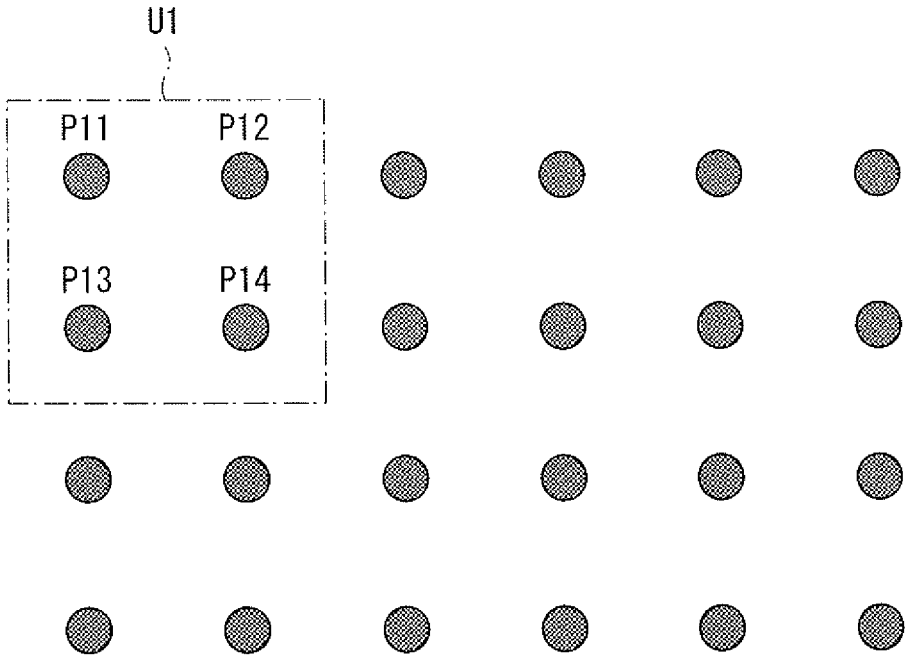
[Fig. 11]
COMPARATIVE EXAMPLE 1 (IN CENTER OF RETINA)
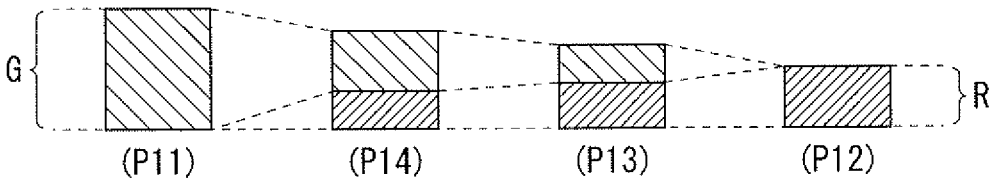

[Fig. 12]
COMPARATIVE EXAMPLE 1 (VISION IN CENTER OF RETINA)
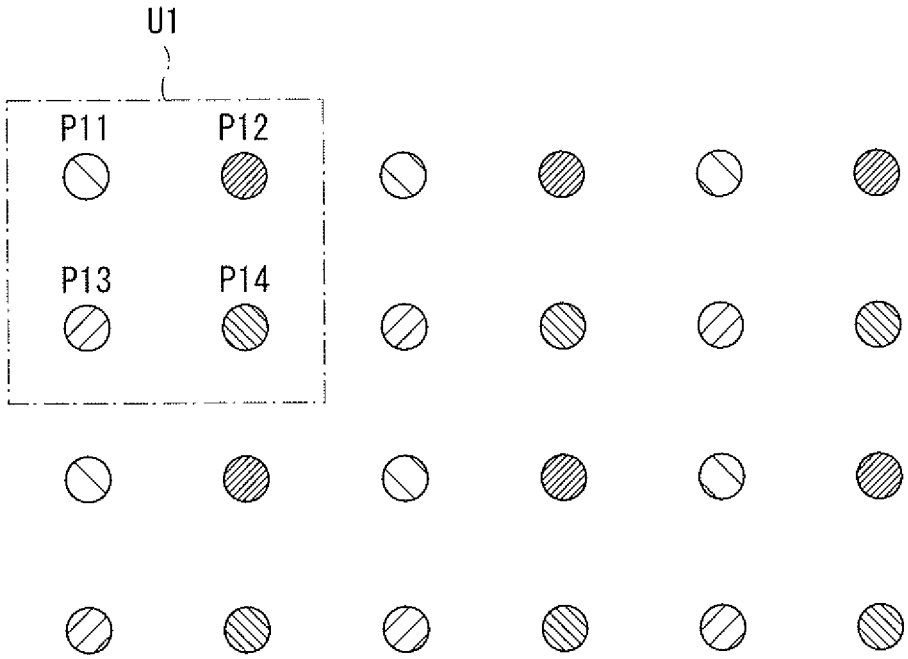

[Fig. 13]
EXAMPLE 1
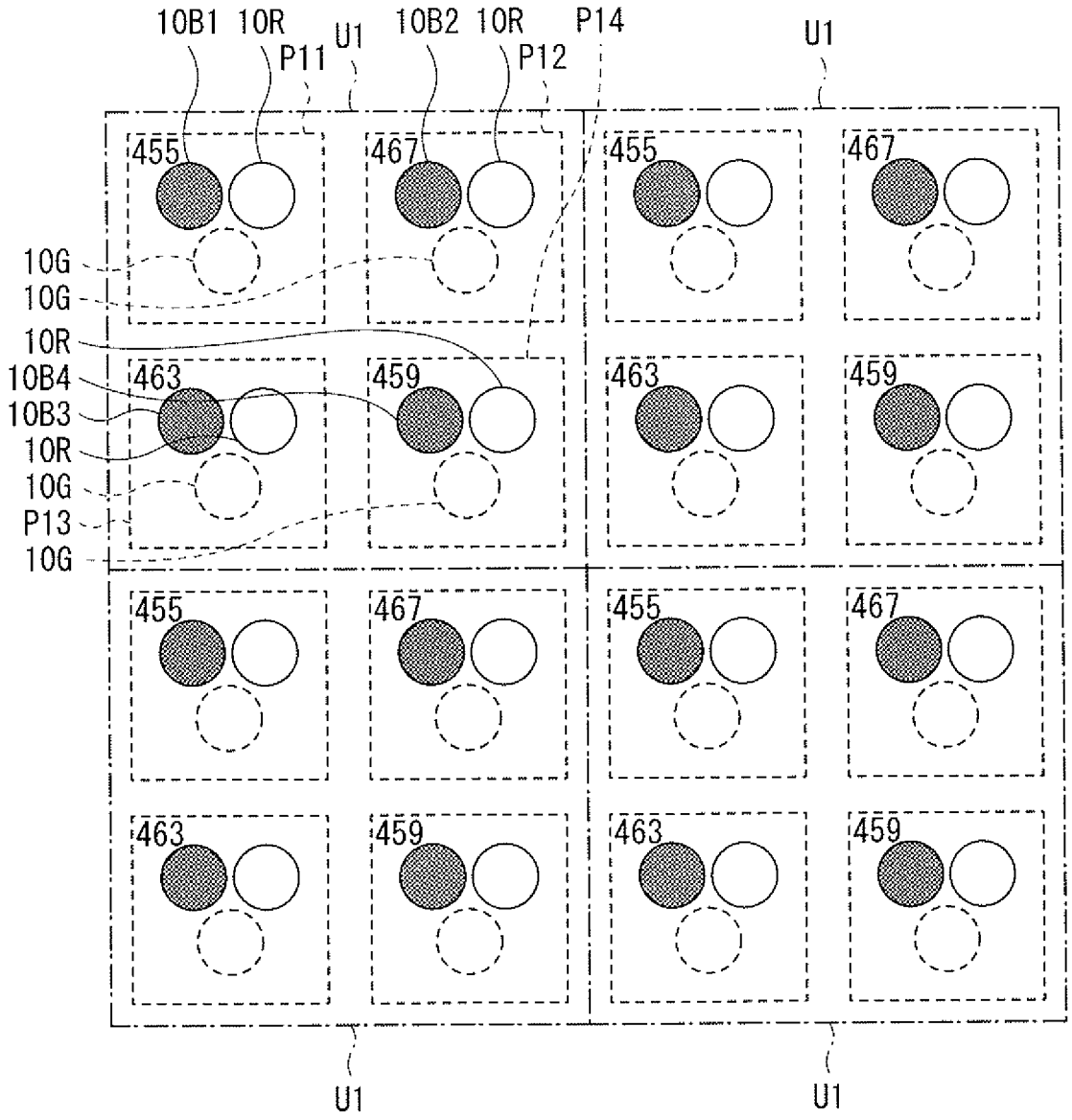

[Fig. 14A]
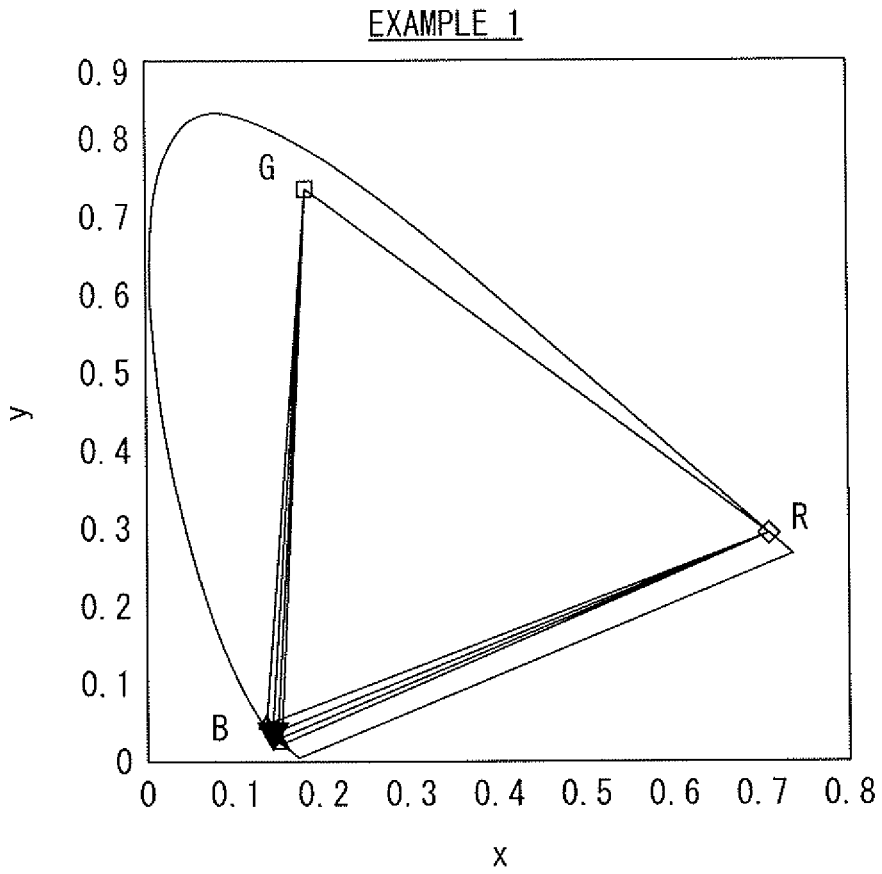
[Fig. 14B]
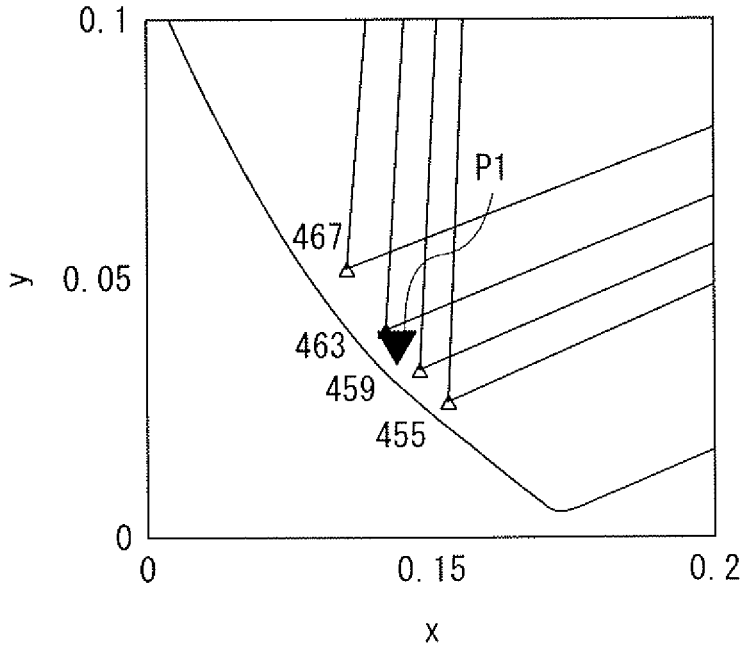

[Fig. 15]
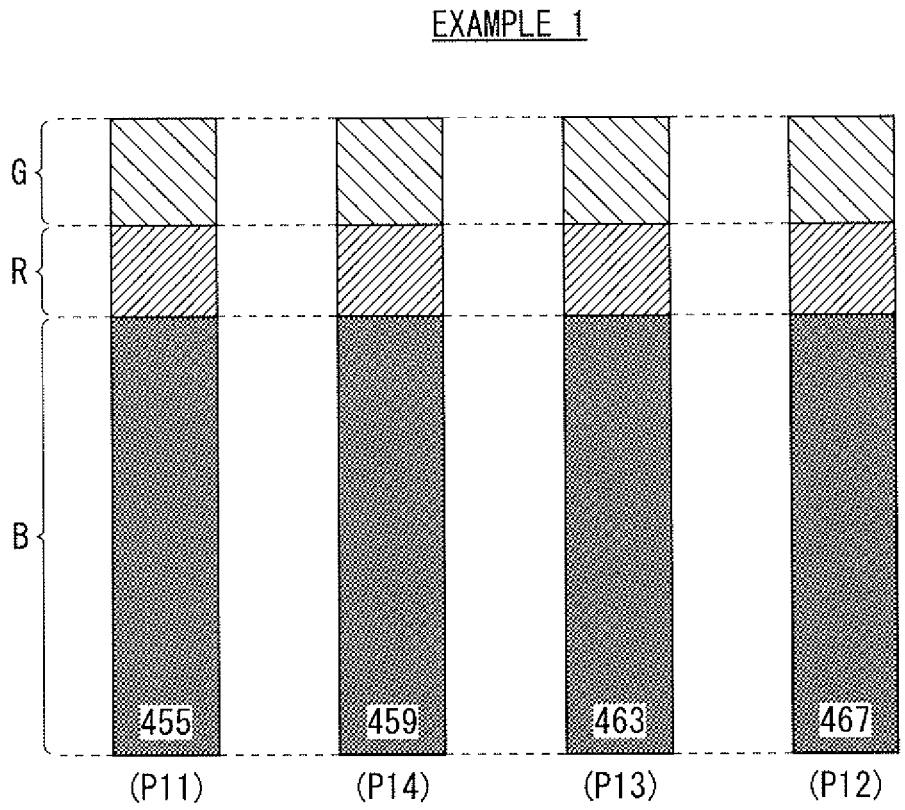
[Fig. 16]
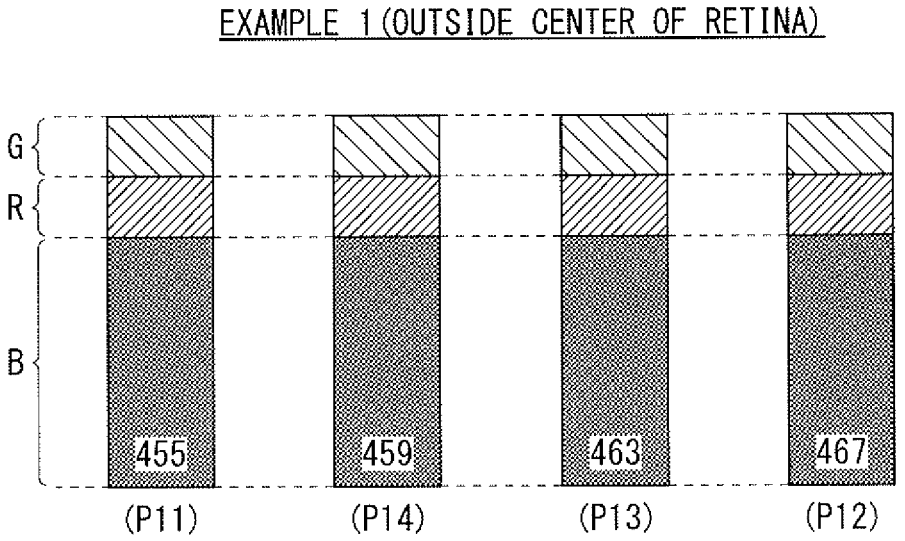

[Fig. 17]
EXAMPLE 1 (VISION OUTSIDE CENTER OF RETINA)
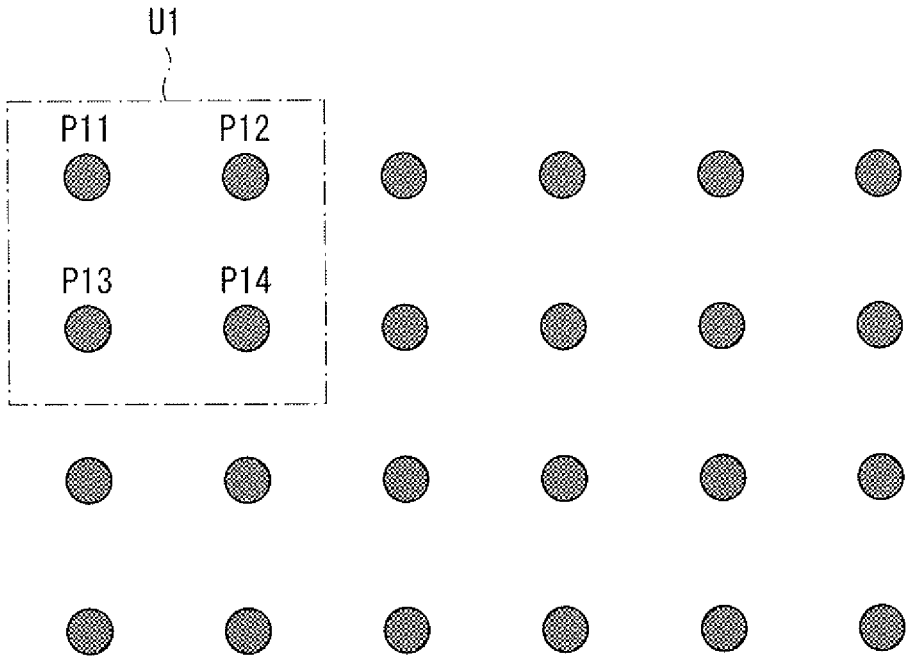
[Fig. 18]
EXAMPLE 1 (IN CENTER OF RETINA)
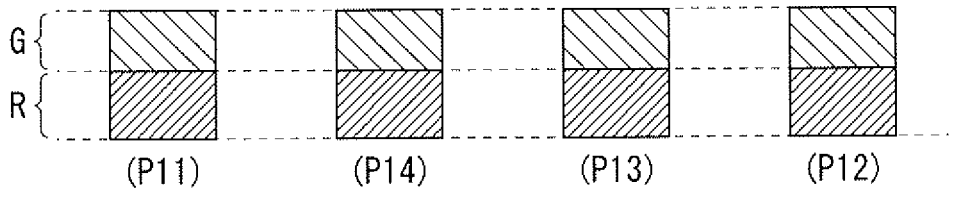

[Fig. 19]
EXAMPLE 1 (VISION IN CENTER OF RETINA)
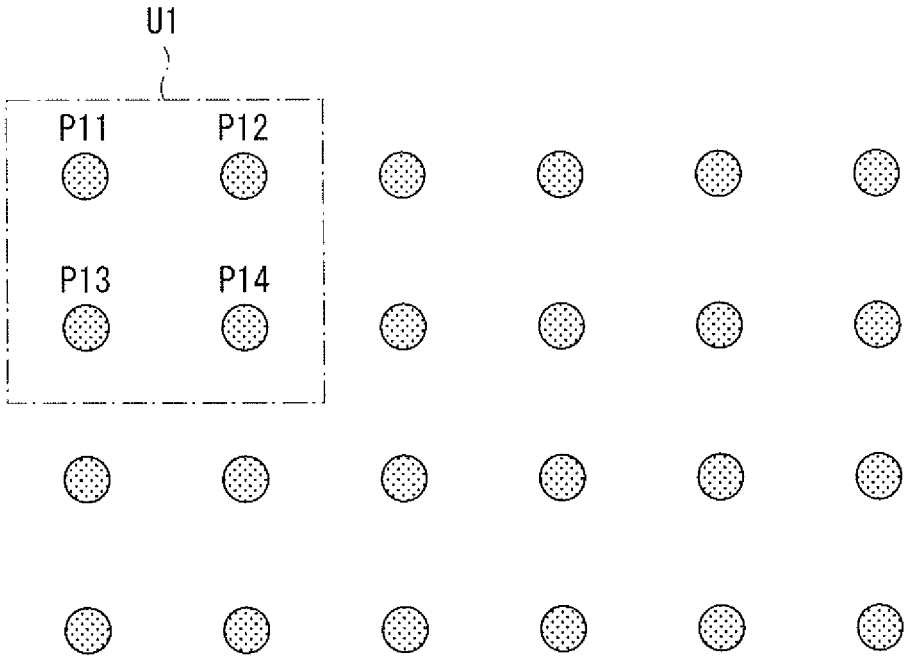

[Fig. 20]
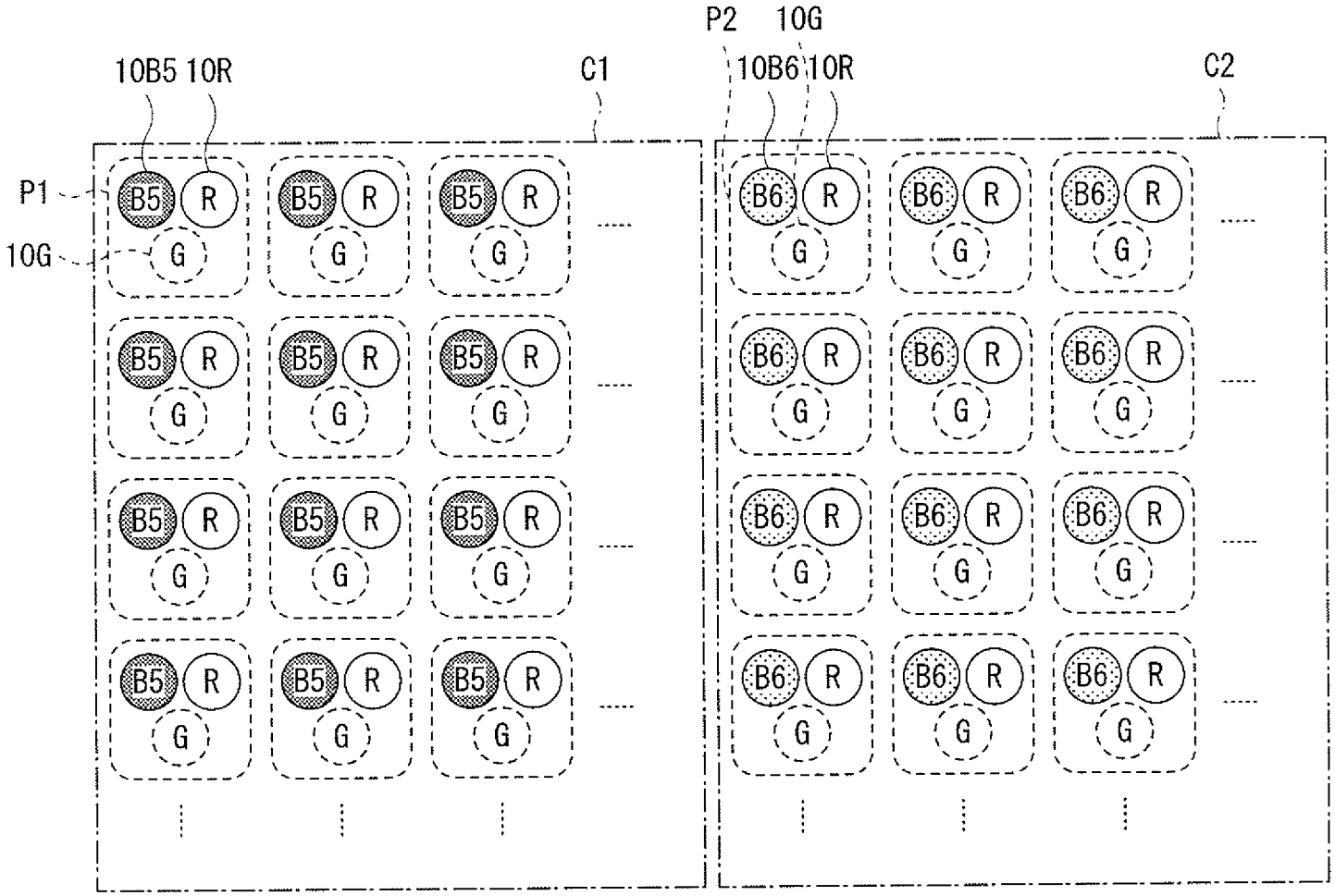

[Fig. 21A]
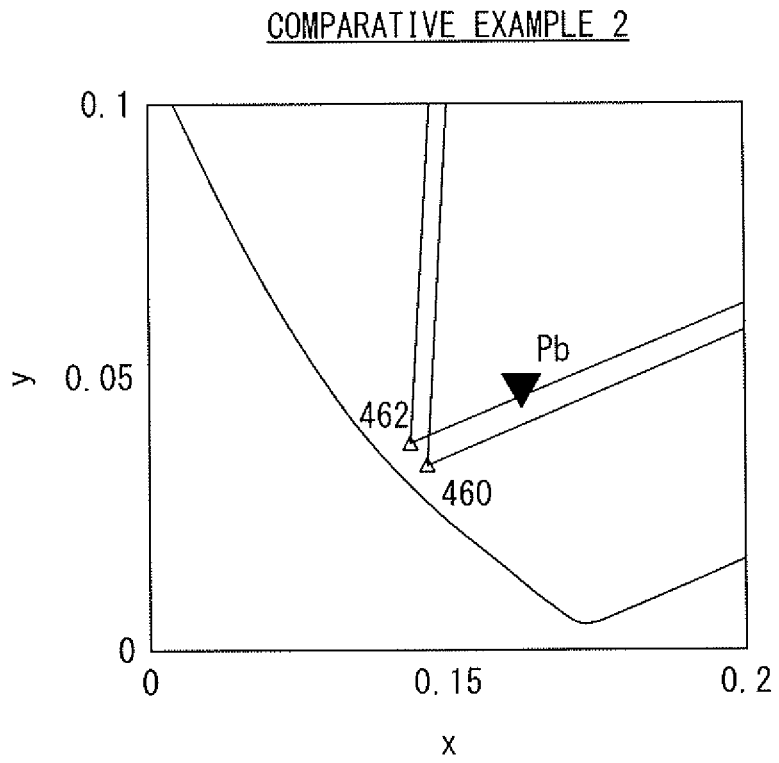
[Fig. 21B]
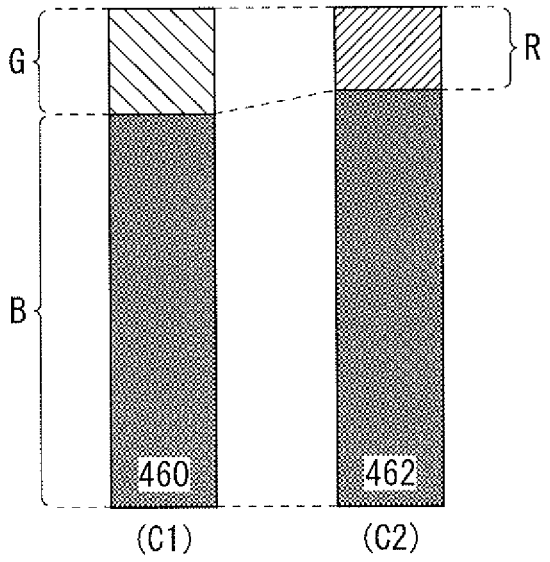

[Fig. 22]
COMPARATIVE EXAMPLE 2(OUTSIDE CENTER OF RETINA)
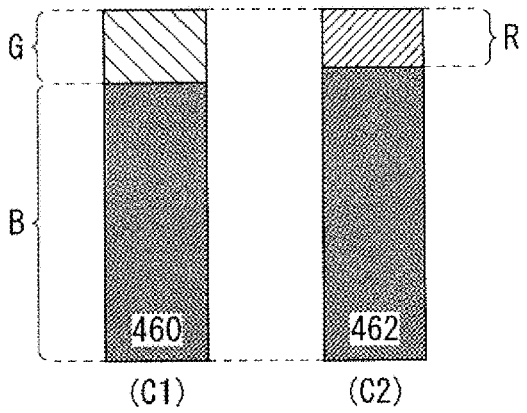
[Fig. 23]
COMPARATIVE EXAMPLE 2(VISION OUTSIDE CENTER OF RETINA)
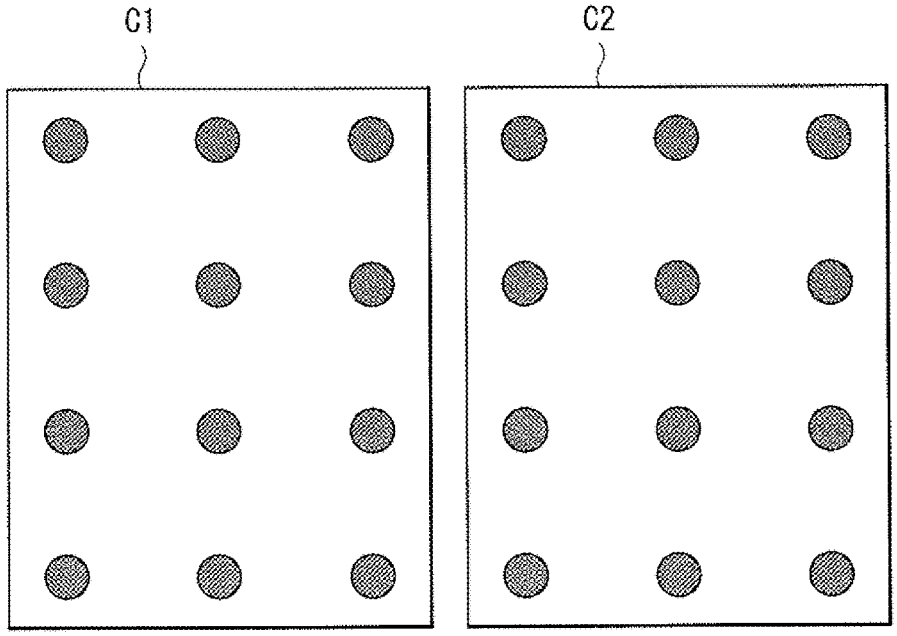
[Fig. 24]
COMPARATIVE EXAMPLE 2(IN CENTER OF RETINA)
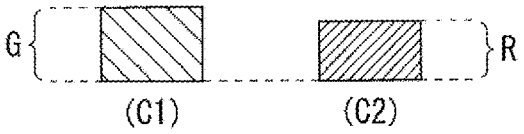

[Fig. 25]
COMPARATIVE EXAMPLE 2 (VISION IN CENTER OF RETINA)
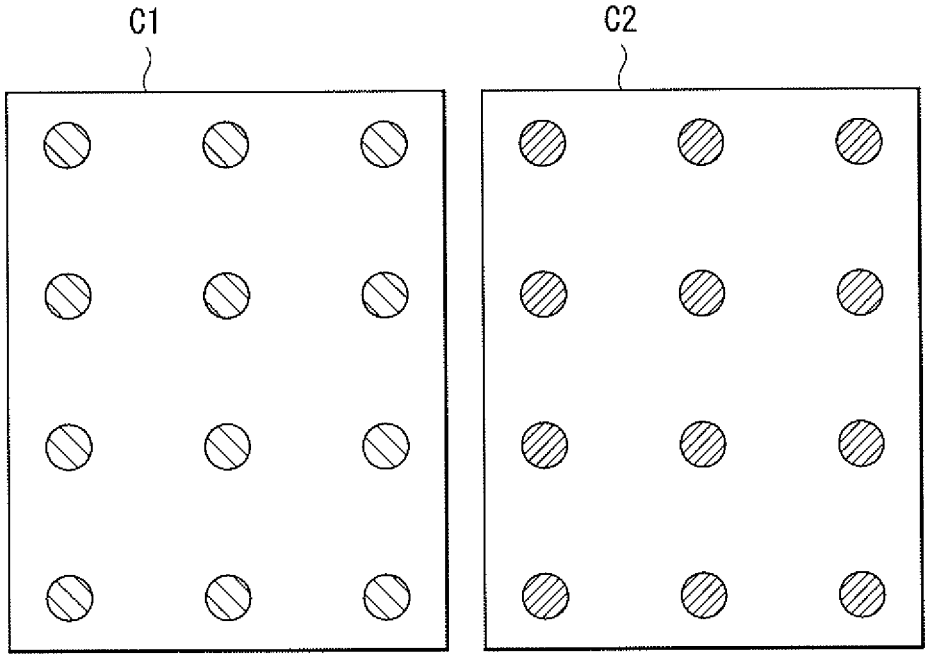
[Fig. 26A]
EXAMPLE 2
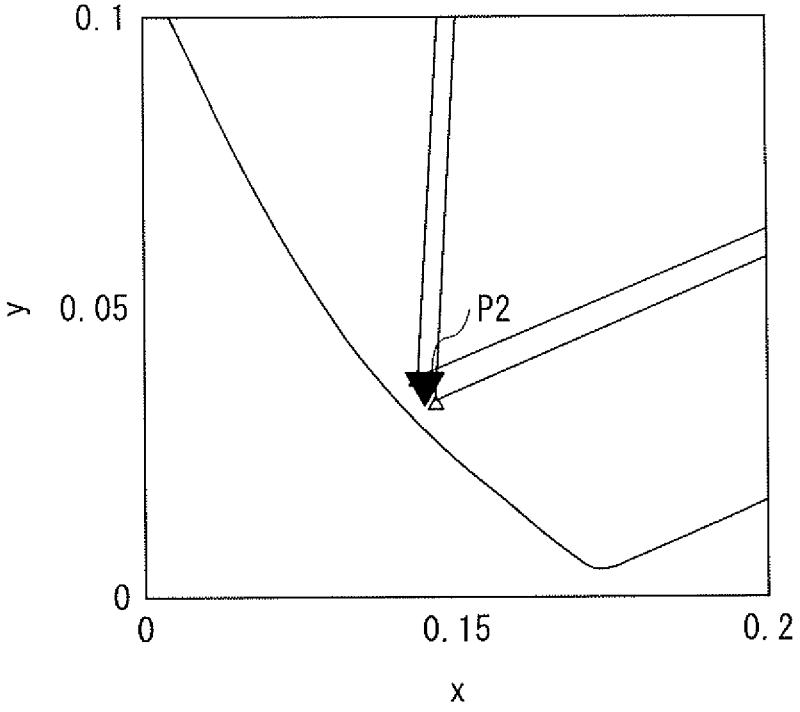

[Fig. 26B]
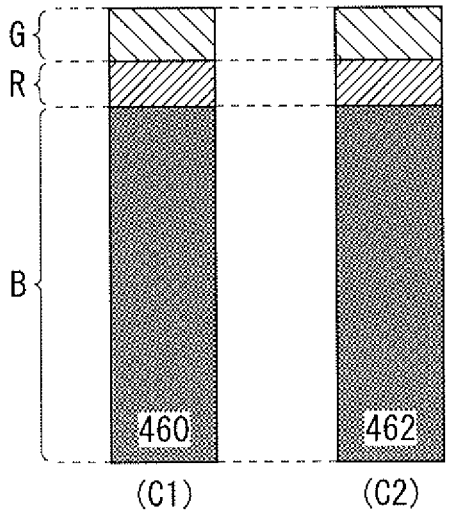
[Fig. 27]
EXAMPLE 2 (OUTSIDE CENTER OF RETINA)
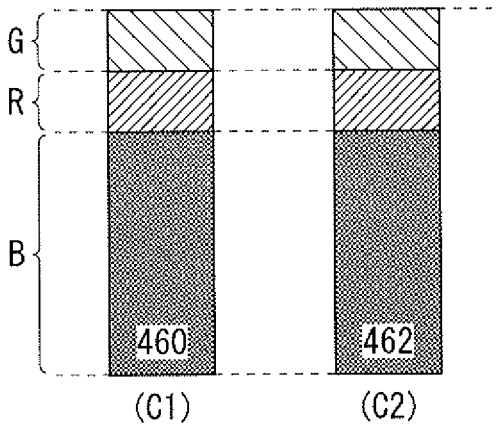

[Fig. 28]
EXAMPLE 2(VISION OUTSIDE CENTER OF RETINA)
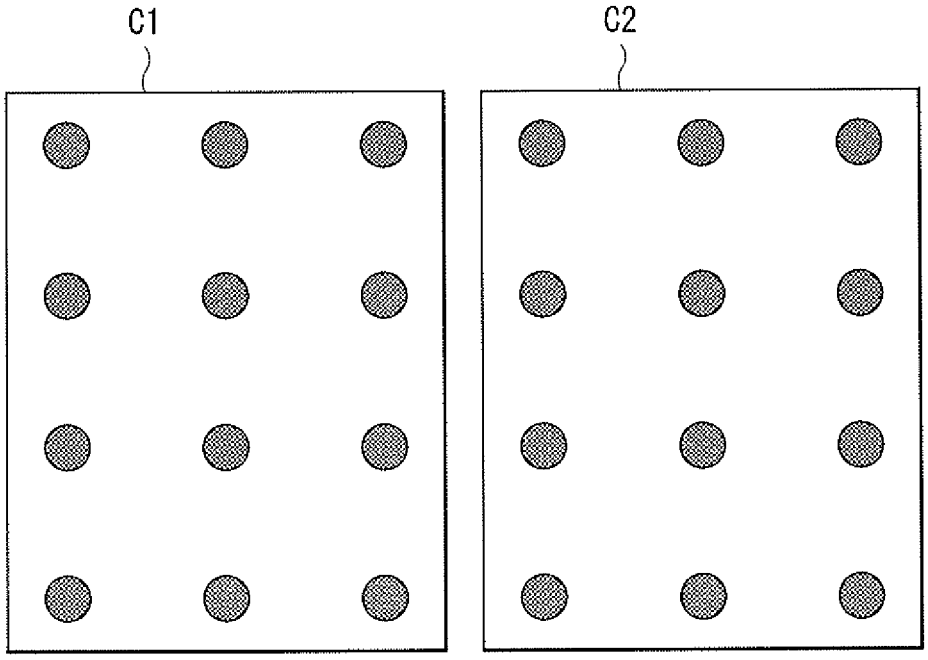
[Fig. 29]
EXAMPLE 2(IN CENTER OF RETINA)
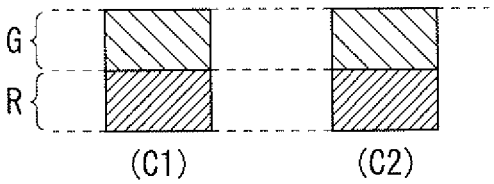

[Fig. 30]
EXAMPLE 2 (VISION IN CENTER OF RETINA)
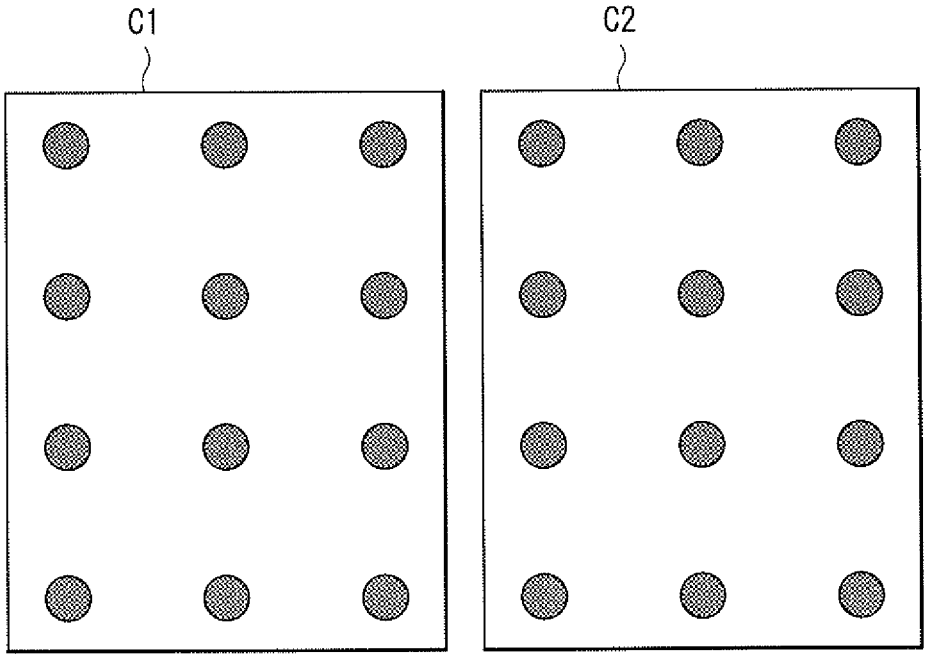
[Fig. 31]
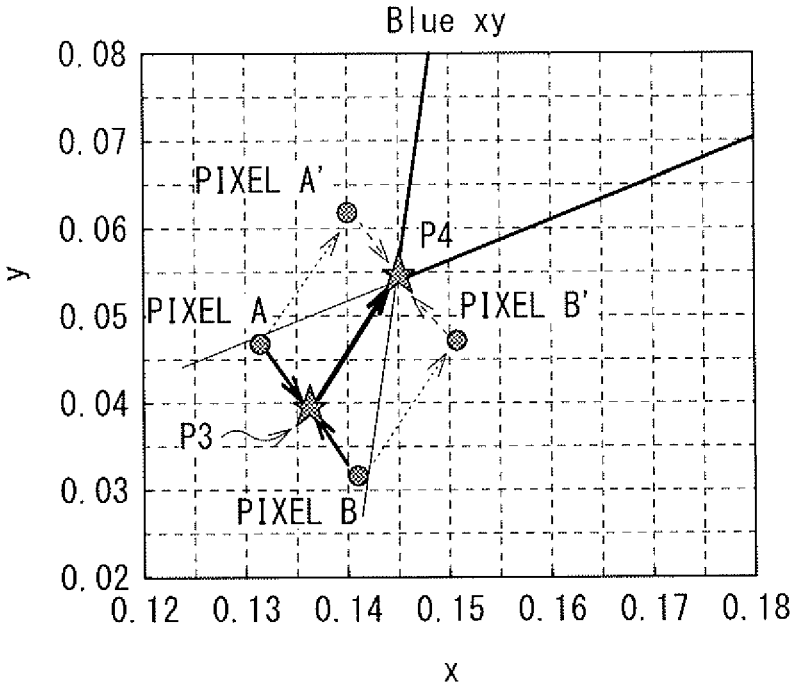

[Fig. 32]
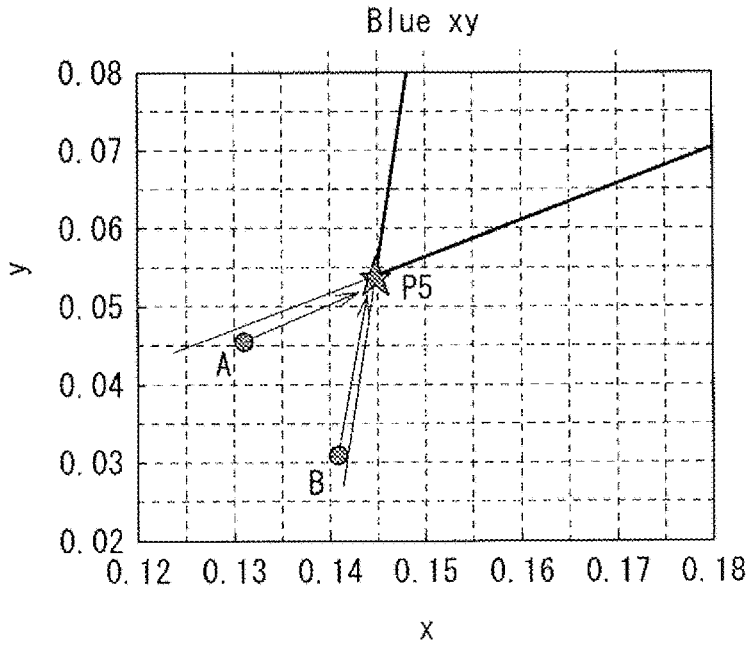
[Fig. 33A]
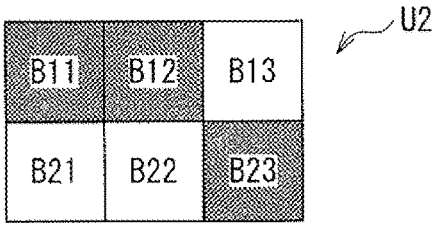
[Fig. 33B]
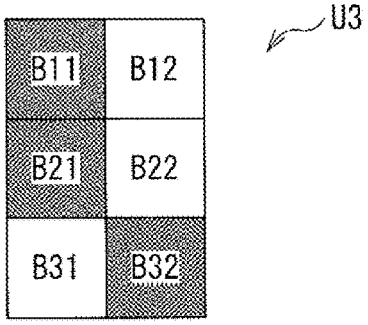
[Fig. 33C]
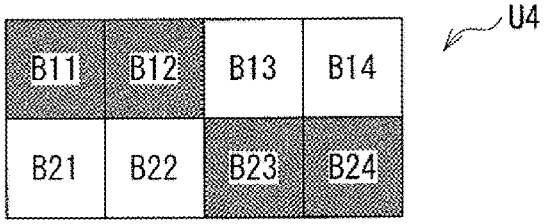

[Fig. 33D]
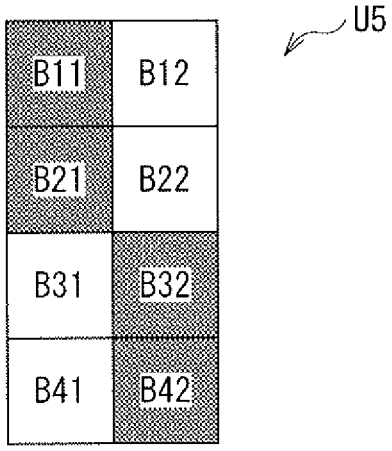
[Fig. 33E]
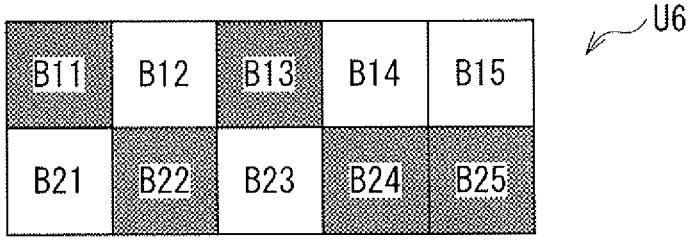
[Fig. 33F]
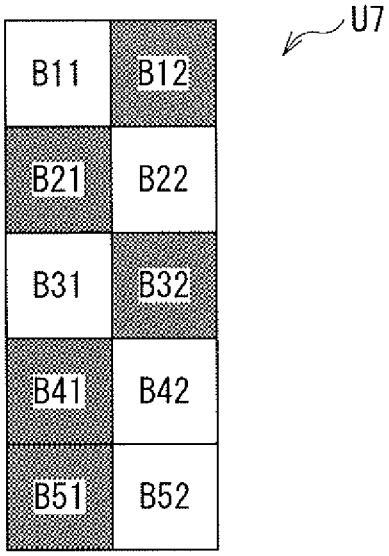

[Fig. 33G]
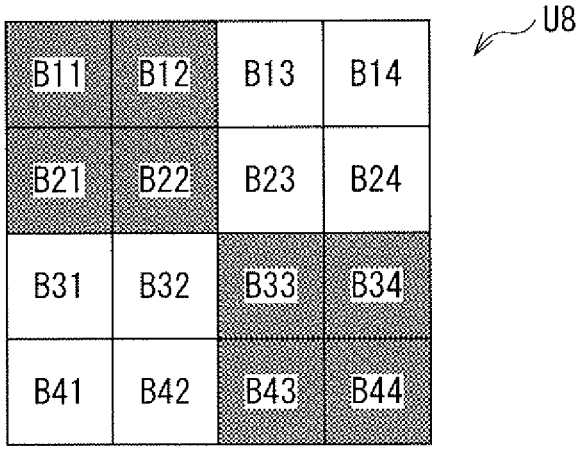

DISPLAY APPARATUS AND CORRECTION METHOD

CROSS-REFERENCE TO RELATED APPLICATIONS

This application is a National Stage of International Application No. PCT/JP2016/000791, filed in the Japanese Patent Office as a Receiving office on. Feb. 16, 2016, which claims priority to Japanese Patent Application Number 2015-053462, filed in the Japanese Patent Office on Mar. 17, 2015, the entire contents of each of which are incorporated herein by reference,

TECHNICAL FIELD

The disclosure relates to a display apparatus including light-emitting devices corresponding to three primary colors in a pixel, and a correction method.

BACKGROUND ART

For example, as display apparatuses using three primary colors such as R (red), G (green), and B (blue), LED displays using light-emitting diodes (LEDs) have been developed. The LED displays have high luminance and high color purity. The LED displays utilizing characteristics of an LED light source as a point light source are frequently used as indoor and outdoor large displays. Most of the LED displays make it possible to form a seamless large display by combining and arranging some independent modules (by so-called tiling).

In the LEDs, variation in wavelength or color purity occurs due to variation during manufacturing. Typically, most of red LEDs are made of an AlGaInP-based compound semiconductor crystal, and most of blue and green LEDs are made of an AlGaInN-based compound semiconductor crystal. There are various causes of the wavelength variation such as the crystal orientation, composition, thickness, and arrangement of a mixed crystal during crystal growth, and processing accuracy. Since nonuniformity is easily increased in an AlGaInN-based mixed crystal, the wavelength variation easily occurs specifically in the blue and green LEDs.

When LEDs that vary in wavelength and chromaticity are provided in respective pixels, it may be difficult to match colors of the respective pixels, thereby causing degradation in image quality such as rough display, the occurrence of color unevenness in a display screen, a difference in color between tiled units, and difficulty in displaying an exact color.

Accordingly, there is disclosed a technology for measuring variation (characteristics) in wavelengths of respective LEDs of R, G, and B between pixels to correct luminance and chromaticity (for example, refer to PTL 1).

CITATION LIST

Patent Literature

[PTL 1] Japanese Unexamined Patent Application Publication No. 2000-155548

SUMMARY

Technical Problem

The foregoing luminance correction and the foregoing chromaticity correction allow for reduction in luminance unevenness and color unevenness, thereby improving image quality. However, it is desirable to achieve other techniques allowing for further improvement in image quality.

It is desirable to provide a display apparatus and a correction method that allow for an improvement in image quality.

Solution to Problem

In some embodiments, a display apparatus may comprise a display section and circuitry. The display section may comprise a plurality of display units arranged in a two-dimensional array, wherein each of the display units comprises a plurality of pixels arranged in a matrix, and each of the plurality pixels comprises a plurality of light-emitting devices that are each configured to emit a different color of light. The circuitry may be configured to generate a corrected image signal based on an uncorrected image signal and correction factors that correct luminance and chromaticity of the light-emitting devices, including at least some correction factors determined by adjusting light emission intensity ratios of first light-emitting devices that are configured to emit light of a particular color and are disposed in different ones of the plurality of pixels.

In some embodiments, a display apparatus may comprise a display section and circuitry. The display section may comprise a plurality of display units arranged in a two-dimensional array, wherein each of the display units comprises a plurality of pixels arranged in a matrix, and each of the plurality pixels comprises a plurality of light-emitting devices that are each configured to emit a different color of light. The circuitry may be configured to generate a corrected image signal based on an uncorrected image signal and correction factors that correct luminance and chromaticity of the light-emitting devices, including at least some correction factors determined by correcting luminance of first light-emitting devices that emit light of a particular color, and determining correction factors for correcting chromaticities of the first light emitting devices based on chromaticities of the luminance-corrected first light-emitting devices that are disposed in different pixels.

In some implementations, each of the display units may comprise a unit array of pixel assemblies that each comprises a plurality of adjacent pixels, the first light-emitting devices may vary in light emission wavelength according to pixel positions, and at least one of the correction factors may be determined for each of the pixel assemblies by adjusting light emission intensity ratios of the first light-emitting devices disposed in different pixels.

In some implementations, the correction factor for each of the pixel assemblies may be determined by performing a calculation in which the light emission intensity ratios of the first light-emitting devices in that pixel assembly are assumed to have a uniform value.

In some embodiments, a method may be performed using a display apparatus comprising a plurality of display units arranged in a two-dimensional array, wherein each of the display units comprises a plurality of pixels arranged in a matrix, and each of the plurality pixels comprises a plurality of light-emitting devices that are each configured to emit a different color of light. The method may comprise an act of determining correction factors for correcting luminance and chromaticity of each of the light-emitting devices by adjusting light emission intensity ratios of first light-emitting devices that are configured to emit light of a particular color and are disposed in different ones of the plurality of pixels.

In some embodiments, a method may performed using a display apparatus comprising a plurality of display units arranged in a two-dimensional array, wherein each of the display units comprises a plurality of pixels arranged in a matrix, and each of the plurality pixels comprises a plurality of light-emitting devices that are each configured to emit a different color of light. The method may comprise an act of determining correction factors for correcting luminance and chromaticity of each of the light-emitting devices by (a) correcting luminance of first light-emitting devices that emit light of a particular color, and (b) determining correction factors for correcting chromaticities of the first light emitting devices based on chromaticities of the luminance-corrected first light-emitting devices that are disposed in different pixels.

Advantageous Effects of Invention

In the first display apparatus and the first correction method according to the embodiments of the disclosure, in order to correct the luminance and the chromaticity of the first primary color, the correction factor determined by adjusting the light emission intensity ratios of the light-emitting devices of the first primary color provided in two or more pixels is used. In a case where the luminance and the chromaticity of the first primary color are corrected by adding other primary colors by, for example, the additive mixing, using the correction factor makes it possible to reduce variation in chromaticity that is easily visually recognized in the center section of the retina of the human eye. This makes it possible to improve image quality.

In the second display apparatus and the second correction method according to the embodiments of the disclosure, the luminance of the first primary color is corrected in each of the pixels, and the chromaticity of the first primary color is corrected with use of the correction factor determined, based on the chromaticities of the light-emitting devices of the first primary color provided in two or more pixels. This makes it possible to reduce the occurrence of the phenomenon in which hues and brightness differ by the visual field. This makes it possible to improve image quality.

It is to be noted that the above description is merely examples of the embodiments of the disclosure. Effects of the embodiments of the disclosure are not limited to effects described here, and may be different from the effects described here or may further include any other effect.

It is to be understood that both the foregoing general description and the following detailed description are exemplary, and are intended to provide further explanation of the technology as claimed.

BRIEF DESCRIPTION OF DRAWINGS

FIG. 1 is schematic view illustrating an entire configuration example of a display apparatus according to a first embodiment of the disclosure.

FIG. 2 is a schematic view illustrating a specific configuration example of a correction factor obtaining section illustrated in FIG. 1.

FIG. 3 is a schematic plan view illustrating a pixel array example of a display section illustrated in FIG. 1.

FIG. 4 is a schematic view for describing an array of light-emitting devices corresponding to long wavelengths and light-emitting devices corresponding to short wavelengths of the display section illustrated in FIG. 3.

FIG. 5 is a flowchart from obtainment of a correction factor to driving of the display section.

FIG. 6 is a schematic view illustrating an example of wavelength variation for describing a correction factor according to Comparative Example 1.

FIG. 7A is a chromaticity diagram plotting variation between chromaticity points corresponding to wavelengths illustrated in FIG. 6 and an adjustment chromaticity point (a target chromaticity point).

FIG. 7B is an enlarged view around blue in FIG. 7B.

FIG. 8 is a characteristic diagram schematically illustrating an adjustment operation of luminance and chromaticity of blue by additive mixing according to Comparative Example 1.

FIG. 9 is a characteristic diagram schematically illustrating adjusted luminance and adjusted chromaticity (outside the center of a retina) of blue according to Comparative Example 1.

FIG. 10 a schematic plan view illustrating adjusted vision (outside the center of the retina) of blue according to Comparative Example 1.

FIG. 11 is a characteristic diagram schematically illustrating adjusted luminance and adjusted chromaticity (in the center of the retina) of blue according to Comparative Example 1.

FIG. 12 is a schematic plan view illustrating adjusted vision (in the center of the retina) of blue according to Comparative Example 1.

FIG. 13 is a schematic view illustrating an example of wavelength variation for describing a correction factor according to Comparative Example 1.

FIG. 14A is a chromaticity diagram plotting variation between chromaticity points corresponding to wavelengths illustrated in FIG. 13 and an adjustment chromaticity point (a target chromaticity point).

FIG. 14B is an enlarged diagram around blue in FIG. 14A.

FIG. 15 is a characteristic diagram schematically illustrating an adjustment operation of luminance and chromaticity of blue by additive mixing according to Example 1.

FIG. 16 is a characteristic diagram schematically illustrating adjusted luminance and adjusted chromaticity (outside the center of a retina) of blue according to Example 1.

FIG. 17 is a schematic plan view illustrating adjusted vision (outside the center of the retina) of blue according to Example 1.

FIG. 18 is a characteristic diagram schematically illustrating adjusted luminance and adjusted chromaticity (in the center of the retina) of blue according to Example 1.

FIG. 19 is a schematic plan view illustrating adjusted vision (in the center of the retina) of blue according to Example 1.

FIG. 20 is a schematic plan view illustrating a pixel array example of a display section of a display apparatus according to a second embodiment of the disclosure.

FIG. 21A is a chromaticity diagram plotting variation between chromaticity points and an adjustment chromaticity point (a target chromaticity point) according to Comparative Example 2.

FIG. 21B is a characteristic diagram schematically illustrating an adjustment operation of luminance and chromaticity of blue by additive mixing according to Comparative Example 2.

FIG. 22 is a characteristic diagram schematically illustrating adjusted luminance and adjusted chromaticity (outside the center of a retina) of blue according to Comparative Example 2.

FIG. 23 is a schematic plan view illustrating adjusted vision (outside the center of the retina) of blue according to Comparative Example 2.

FIG. 24 is a characteristic diagram schematically illustrating adjusted luminance and adjusted chromaticity (in the center of the retina) of blue according to Comparative Example 2.

FIG. 25 is a schematic plan view illustrating adjusted vision (in the center of the retina) of blue according to Comparative Example 2.

FIG. 26A is a chromaticity diagram plotting variation between chromaticity points and an adjustment chromaticity point (a target chromaticity point) according to Example 2.

FIG. 26B is a characteristic diagram schematically illustrating an adjustment operation of luminance and chromaticity of blue by additive mixing according to Example 2.

FIG. 27 is a characteristic diagram schematically illustrating adjusted luminance and adjusted chromaticity (outside the center of a retina) of blue according to Example 2.

FIG. 28 is a schematic plan view illustrating adjusted vision (outside the center of the retina) of blue according to Example 2.

FIG. 29 is a characteristic diagram schematically illustrating adjusted luminance and adjusted chromaticity (in the center of the retina) of blue according to Example 2.

FIG. 30 is a schematic plan view illustrating adjusted vision (in the center of the retina) of blue according to Example 2.

FIG. 31 is a chromaticity diagram for describing a correction factor used in a display apparatus according to a third embodiment of the disclosure.

FIG. 32 is a chromaticity diagram for describing a correction factor according to Comparative Example 3.

FIG. 33A is a schematic plan view illustrating a wavelength array according to Modification Example 1-1.

FIG. 33B is a schematic plan view illustrating a wavelength array according to Modification Example 1-2.

FIG. 33C is a schematic plan view illustrating a wavelength array according to Modification Example 1-3.

FIG. 33D is a schematic plan view illustrating a wavelength array according to Modification Example 1-4.

FIG. 33E is a schematic plan view illustrating a wavelength array according to Modification Example 1-5.

FIG. 33F is a schematic plan view illustrating a wavelength array according to Modification Example 1-6.

FIG. 33G is a schematic plan view illustrating a wavelength array according to Modification Example 1-7.

DESCRIPTION OF EMBODIMENTS

Some embodiments of the disclosure will be described in detail below with reference to the accompanying drawings. It is to be noted that description will be given in the following order.

1. First Embodiment (An example of a display apparatus in which luminance and chromaticity are corrected with use of a correction factor determined by adjusting light emission intensity ratios of blue LEDs in an assembly)
2. Second Embodiment (An example of a display apparatus in which luminance and chromaticity are corrected with use of a correction factor determined by adjusting light emission intensity ratios of blue LEDs in units)
3. Third Embodiment (An example of a display apparatus in which chromaticity is corrected with use of a correction factor determined by computing each of chromaticities of blue LEDs in a plurality of pixels)
4. Modification Examples 1-1 to 1-7 (Other examples of a wavelength array)

First Embodiment (Configuration)

FIG. 1 illustrates an example of an entire configuration of a display apparatus (a display apparatus 1) according to a first embodiment of the disclosure. The display apparatus 1 may include, for example, a display section 10, a drive section 20, a control section 30, and a correction processing section 31. The display section 10 may include, for example, a plurality of display units Cn. It is to be noted that the drive section 20, the control section 30, and the correction processing section 31 correspond to specific examples of "drive section" in an embodiment of the disclosure.

The display section 10 may be configured of, for example, a combination of the plurality of display units Cn. The plurality of display units Cn are two-dimensionally arranged in the display section 10. Each of the plurality of display units Cn may include, for example, a plurality of pixels arranged in a matrix. Light-emitting devices corresponding to three primary colors are provided in each of the pixels. Examples of the light-emitting devices may include light-emitting diodes (LEDs) that are configured to emit color light of red (R), green (G), and blue (B). A red LED may be made of, for example, an AlGaInP-based material, and a green LED and a blue LED may be made of, for example, an AlGaInN-based material (including an AlGaInN-based light-emitting diode). In the display section 10, each of the pixels is pulse-driven, based on an image signal to adjust luminance of each of the LEDs, thereby displaying an image.

The drive section 20 is configured to drive (perform display drive on) each of the pixels of the display section 10, and may include, for example, a constant current driver. The drive section 20 may be configured to drive the display section 10 by, for example, pulse-width modulation (PWM) with use of a corrected image signal (an image signal D4) supplied from the control section 30.

The control section 30 may include a micro-processing unit (MPU). The display apparatus 1 may be connected (or connectable) to, for example, a correction factor obtaining section 40 to allow for transmission and reception of signals. The correction factor obtaining section 40 and the display apparatus 1 configure a display system 1A. In the display system 1A, correction factor data (correction factor data D3 that will be described later) is supplied from the correction factor obtaining section 40 to the correction processing section 31. The display apparatus 1 may not be necessarily configured to be connectable to the correction factor obtaining section 40. In other words, the correction processing section 31 may be configured to hold the correction factor data D3 in advance.

The correction processing section 31 may include, for example, a data memory that is able to hold the correction factor data D3, and is a signal processing section configured to correct luminance and chromaticity, based on the held correction factor data D3.

The correction factor obtaining section 40 is a processing section that is configured to obtain, by computation, a correction factor for suppressing variation in luminance and chromaticity caused by wavelength (light emission wavelength) variation of the LEDs provided in the pixels of the display section 10 to uniformize the luminance and the chromaticity. It is to be noted that, in the description, the terms "wavelength" and "light emission wavelength" refer to a so-called dominant wavelength.

FIG. 2 illustrates an example of a specific configuration of the correction factor obtaining section 40. As illustrated in the drawing, the correction factor obtaining section 40 may include, for example, a camera 41, a luminance-chromaticity measurement section 42, a computation processing section 43, and a storage section 44. It is to be noted that, upon a correction factor obtaining operation, an LED drive section 45 drives the display units Cn by a constant current.

The camera 41 may be, for example, a CCD (Charge Coupled Device Image Sensor) camera for shooting of an entire display screen of the display unit Cn. The luminance-chromaticity measurement section 42 is configured to measure luminance and chromaticity of each of the LEDs, based on shooting data (shooting data D1) obtained by the camera 41. The computation processing section 43 is configured to perform processing for suppressing variation in the luminance and the chromaticity, based on data (luminance-chromaticity data D2) of the measured luminance and the measured chromaticity to uniformize (adjust) the luminance and the chromaticity, thereby determining the correction factor. Correction factor data (correction factor data D3) determined by the computation processing section 43 is stored in the storage section 44. The correction factor data D3 may be outputted to the correction processing section 31 of the display apparatus 1 in response to, for example, control by the control section 30. It is to be noted that the correction factor determined here may include not only a correction factor for perfectly uniformizing chromaticity but also a correction factor that may cause slight chromaticity variation. As long as chromaticity variation is reduced to an acceptable image quality level, the chromaticity may not be necessarily perfectly uniformized.

In this embodiment, the LEDs vary in wavelength between the pixels in the display section 10 (the display unit Cn). Such wavelength variation may occur in, for example, a process of manufacturing the LEDs, and may be caused by a deviation, from a design value, of the wavelength of each LED in a wafer or the wavelengths of LEDs in each wafer. Since the respective LEDs in the display unit Cn are transferred from a plurality of wafers or one wafer, wavelength variation between pixels may occur, and the wavelength variation may be formed, for example, periodically repeatedly. Although a configuration in which the LEDs corresponding to varied wavelengths are periodically arranged is exemplified here, the LEDs corresponding to varied wavelengths may not be necessarily periodically arranged. One reason for this is that the LEDs corresponding to varied wavelengths may be arranged in various patterns according to techniques of forming LEDs.

There are various causes of the wavelength variation such as the crystal orientation, composition, thickness, and arrangement of a mixed crystal during crystal growth, and processing accuracy. In particular, in the blue and green LEDs, for example, the composition of an AlGaInN-based mixed crystal easily becomes nonuniform, thereby easily causing wavelength variation. Wavelength variation between these blue LEDs (or these green LEDs) (a difference between the longest blue wavelength and the shortest blue wavelength) may be, for example, about 10 nm or more, and may be about 15 nm or more in some cases.

FIG. 3 illustrates an example of a pixel array in the display unit Cn. The display unit Cn may include, as unit arrays, assemblies (assemblies U1) of two or more adjacent pixels, for example, 2*2 pixels. Blue LEDs corresponding to different wavelengths from one another are provided in each of the assemblies U1 according to pixel positions by the foregoing manufacturing and mounting process of LEDs. More specifically, in each of the assemblies U1, blue LEDs 10B1, 10B2, 10B3, and 10B4 corresponding to different wavelengths are respectively provided in four adjacent pixels P11, P12, P13, and P14. In other words, these blue LEDs 10B1 to 10B4 may be mounted from, for example, respective different wafers. It is to be noted that, for simplification of description, the red LEDs 10R and the green LEDs 10G are treated as LEDs without wavelength variation. For the following reasons, it may be desirable to suppress wavelength variation specifically in blue to uniformize the wavelength of blue. The reasons include that variation in blue is the most visible due to features of cells on a human retina in addition to easy occurrence of wavelength variation in blue in the manufacturing process as described above. Accordingly, it is more effective to uniformize the wavelength of blue than the wavelength of green in which wavelength variation equal to or higher in level than that in blue occurs.

It is to be noted that, in actuality, the LEDs of R, G, and B are provided in proximity to one another in one pixel. More specifically, these LEDs are provided in close positions where three colors R, G, and B appear mixed. Alternatively, a distance at which three colors in one pixel are not discerned may be set as an appropriate viewing distance.

In each of the assemblies U1, as described above, the blue LEDs 10B1 to 10B4 vary in wavelength, and in the display unit Cn, the assemblies U1 are provided periodically repeatedly as unit arrays. The blue LEDs 10B1 to 10B4 corresponding to different wavelengths are further divided into a group (G1) corresponding to a relatively long wavelength and a group (G2) corresponding to a relatively short wavelength. It may be desirable to regularly arrange the long wavelength group G1 and the short wavelength group G2.

FIG. 4 illustrates an example of an array of the long wavelength group G1 and the short wavelength group G2. As illustrated in the drawing, for example, it may be desirable that blue LEDs corresponding to wavelengths B2 and B3 configuring the long wavelength group G1 and blue LEDs corresponding to wavelengths B1 and B4 configuring the short wavelength group G2 be provided in a staggered arrangement More specifically, it may be desirable that one of the blue LEDs corresponding to the wavelengths (B2 and B3) belonging to the long wavelength group G1 and one of the blue LEDs corresponding to the wavelengths (B1 and B4) belonging to the short wavelength group G2 be alternately provided along each of a row direction a1 and a column direction a2 in the pixel array. More specifically, along the row direction a1, the blue LEDs corresponding to the wavelengths B1 and B2 are alternately provided adjacent to each other, and the blue LEDs corresponding to the wavelengths B3 and B4 are alternately provided adjacent to each other. Along the column direction a2, the blue LEDs corresponding to the wavelengths B1 and B3 are alternately provided adjacent to each other, and the blue LEDs corresponding to the wavelengths B2 and B4 are alternately provided adjacent to each other. Along an oblique direction a3, the blue LEDs corresponding to the wavelengths G2 and G3 belonging to the long wavelength group G1 are alternately provided, and the blue LEDs corresponding to the wavelengths B1 and B2 belonging to the short wavelength group G2 are alternately provided. It is to be noted that the wavelengths B2 and B3 belonging to the long wavelength group G1 are longer than the wavelengths B1 and B4 belonging to the short wavelength group G2.

(Operation)

In the display apparatus 1 according to this embodiment, when a drive current is supplied from the drive section 20 to each of the pixels of the display section 10, based on an image signal inputted from outside, in each of the pixels, the LEDs of the respective colors emit light with predetermined luminance to display an image on an entire screen of the display section 10 by additive mixing of the three primary colors.

In the display apparatus 1 using such LEDs, as described above, specifically in the blue LEDs, wavelength variation due to the causes such as the manufacturing process occurs. This wavelength variation causes variation in luminance and chromaticity between pixels to result in degradation in image quality. Accordingly, in order to allow for displaying of an image with desired luminance and desired chromaticity even in a case where such wavelength variation occurs, the luminance and the chromaticity are corrected. More specifically, the correction processing section 31 corrects the luminance and the chromaticity, based on the correction factor (the correction factor data D3) obtained by the correction factor obtaining section 40 or the correction factor data D3 stored in advance, and the drive section 20 drives the display section 10 with use of the corrected image signal.

FIG. 5 illustrates a flow from a correction factor obtaining operation to a display driving operation in this embodiment. First, as illustrated in the drawing, the correction factor obtaining section 40 obtains the correction factor (steps S11 to S15). More specifically, as illustrated in FIG. 2, all of the pixels of the display unit Cn are turned on by the LED drive section 45 (step S11), and all of the pixels are shot with the camera 41 to obtain the shooting data D1 (step S12). Thereafter, the luminance-chromaticity measurement section 42 measures luminance and chromaticity in all of the pixels, based on the shooting data D1 obtained by the camera 41 to obtain the luminance-chromaticity data D2 (step S13). The computation processing section 43 determines a correction factor for uniformizing luminance and chromaticity from the luminance-chromaticity data D2 obtained in such a manner (step S14). Data (the correction factor data D3) of the determined correction factor is stored in the storage section 44 (step S15). The foregoing processes (S11 to S15) are performed on each of the display units Cn to obtain the correction factor data D3 of all of the display units Cn. It is to be noted that, in the step S11, all of the pixels of the display unit Cn may be turned on simultaneously or sequentially. Moreover, in the step S12, all of the pixels in the display unit Cn may be divided into some blocks, and the blocks in the blocks may be shot from one block to another.

Thereafter, the respective display units Cn are arranged in combination (tiled) to assemble the display section 10 (step S16). The correction processing section 31 corrects luminance and chromaticity of the image signal inputted from outside with use of the correction factor data D3. The corrected image signal D4 is outputted to the drive section 20. The drive section 20 drives the display section 10 with use of the image signal D4 (step S17).

Even in a case where wavelength variation occurs due to the causes such as the manufacturing process, correction of luminance and chromaticity with use of the correction factor according to the wavelength variation makes it possible to display an image with desired luminance and desired chromaticity and suppress degradation in image quality.

A correction factor for luminance and chromaticity of blue according to a comparative example (Comparative Example 1) of this embodiment will be described below. In Comparative Example 1, as illustrated in FIG. 6, it is assumed that blue LEDs 10B1 to 10B4 corresponding to different wavelengths are respectively provided in pixels P11 to P14. More specifically, the wavelengths of the blue LEDs 10B1, 10B2, 10B3, and 10B4 are 455 nm, 467 nm, 463 nm, and 459 nm, respectively. It is to be noted that, for simplification, the red LEDs 10R and the green LEDs 10G are treated as LEDs without wavelength variation.

In Comparative Example 1, after the luminance and chromaticity of each of the pixels P11 to P14 are measured, the luminance and the chromaticity are adjusted by additive mixing of R, G, and B in each of the pixels P11 to P14. For example, a chromaticity point of blue in each pixel is adjusted by adding red and green to the chromaticity point when only the blue LED emits light to shift the chromaticity point to a target chromaticity point. Adjustment by the additive mixing is performed in such a manner to obtain predetermined chromaticity and predetermined luminance in all pixels. In principle, this makes it possible to make chromaticity and luminance in a screen (in all pixels) uniform.

More specifically, when chromaticities of LEDs of the colors R, G, and B are plotted as illustrated in FIGS. 7A and 7B, the chromaticity point of blue varies due to wavelength variation. In Comparative Example 1, such variation in chromaticity point is adjusted by additive mixing of red and green to uniformize the chromaticity of blue. In the additive mixing, chromaticity in a triangular range with respective chromaticity points of R, G, and B as vertices is able to be represented. In other words, four triangles with respective four chromaticity points of B corresponding to respective four wavelengths are formed. Using, as a correction point (a correction point Pb), a chromaticity point at a vertex of a portion shared by these four triangles (a shaded portion in FIG. 7B) makes it possible to uniformize the chromaticity of blue in the pixels P11 to P14.

For example, in a case where chromaticity points corresponding to the short wavelength (the chromaticity points of the pixels P11 and P14) of the chromaticity points of blue are shifted to the correction point Pb, more green is additively mixed than red. In a case where chromaticity points corresponding to the long wavelength (the chromaticity points of the pixels P13 and P12) are shifted to the correction point Pb, red is mixed more than green. The color mixing ratios (light emission intensity ratios) in such cases are as schematically illustrated in FIG. 8. Moreover, in order to make luminance uniform in the pixels P11 to P14, total luminance of R, G, and B is adjusted to be equal in the pixels P11 to P14 while maintaining the light emission intensity ratios. In the example in FIG. 8, the luminance is uniform in the pixels P11 to P14. Thus, in Comparative Example 1, a correction factor for shifting each measured chromaticity point of blue to the correction point Pb is determined by computation, and the luminance and the chromaticity of blue are corrected with use of the correction factor.

In order to determine the correction factor, the comparative example uses color matching functions defined by CIE (Commission Internationale de l'Eclairage), i.e., luminosity curves of an eye relative to an energy spectrum of light. The color matching functions vary between individuals, and vary by, for example but not limited to, a visual angle and ambient brightness. Therefore, even if the chromaticity and the luminance are adjusted to be computationally equal, a phenomenon in which vision in the center of the visual field is different from vision in the periphery of the visual field occurs. In actuality, in an LED display, even if the luminance and the chromaticity are computationally corrected, variation between pixels may be perceived, or a boundary between the tiled display units may be visually recognized.

This is caused by no consideration of a difference in photoreceptor cell distribution between the center and the periphery (outside the center) of a human retina, and a difference in vision between individuals.

FIG. 9 schematically illustrates adjusted luminance and adjusted chromaticity (after shifting to the correction point Pb) of blue outside the center of the retina in Comparative Example 1. FIG. 10 schematically illustrates vision of blue outside the center of the retina. As illustrated in the drawings, in Comparative Example 1, uniform blue is expressed in the pixels P11 to P14 outside the center of the retina (uniform blue is perceived).

However, in the center of the retina, less S cone cells having sensitivity to blue are distributed, and more L cone cells and more M cone cells respectively having sensitivity to red and green are distributed. Moreover, few rod cells with high sensitivity to a blue-green range are present in a fovea of the retina. For this reason, it is difficult to perceive blue in the center of the retina. FIG. 11 schematically illustrates adjusted luminance and adjusted chromaticity (after shifting to the correction point Pb) of blue in the center of the retina in Comparative Example 1. FIG. 12 schematically illustrates vision of blue in the center of the retina. It is to be noted that, in FIG. 12, a difference in hue is schematically illustrated by a difference in hatching. Since the center of the retina hardly perceives blue, as schematically illustrated in FIGS. 11 and 12, in the pixels P11 and P14 corresponding to a short wavelength, a strong green hue is perceived, and in the pixels P12 and P13 corresponding to a long wavelength, a strong red hue is perceived. As a result, as with Comparative Example 1, when the luminance and the chromaticity of each pixel are corrected with use of the color matching functions, variation in brightness and hue occurs in the center of retina. Such variation may cause impairment of image quality of a display.

As described above, in a case where the LEDs vary in wavelength, it is difficult to reproduce a high-quality image. It is to be noted that there is considered a method in which the characteristics of the LEDs are measured to be classified, and only the LEDs classified into a specific rank of extremely small variation (for example, about 2 nm to about 4 nm or less) is used; however, manufacturing cost is enormous, and it is difficult to make the method popular.

In this embodiment, the luminance and the chromaticity are corrected with use of the correction factor determined by adjusting the light emission intensity ratios of blue in two or more pixels. More specifically, the light emission intensity ratios of the blue LEDs 10B1 to 10B4 respectively provided in the pixels P11 to P14 configuring the assembly U1 serving as a unit array of the display unit Cn are adjusted to a uniform value to determine the correction factor. In other words, in the assembly U1, the light emission intensity of blue is treated as a uniform value, and the correction factor is determined. As illustrated in FIG. 13, a case where the blue LEDs 10B1, 10B2, 10B3, and 10B4 respectively have 455 nm, 467 nm, 463 nm, and 459 nm will be described below as Example 1.

Even in this embodiment, as with the foregoing Comparative Example 1, when chromaticities of LEDs of R, G, and B are plotted as illustrated in FIGS. 14A and 14B, the chromaticity point of blue varies due to wavelength variation. In order to suppress variation in the chromaticity point to uniformize the chromaticity point, the intensity ratios of the red LEDs 10R and the green LEDs 10G are adjusted (additive mixing is performed). Unlike Comparative Example 1, in this embodiment, first, the light emission intensity ratios of the blue LEDs 10B1 to 10B4 are adjusted to treat the chromaticity of blue as a uniform value. In other words, as illustrated in FIG. 15, the light emission intensity ratios of blue in the pixels P11 to P14 are set to a uniform value, and uniform blue is mixed with red and green. Moreover, in order to make luminance uniform in the pixels P11 to P14, total luminance (a height in each graph in FIG. 15) of R, G, and B is adjusted to be equal in the pixels P11 to P4 while maintaining the light emission intensity ratios. Such adjustment of the light emission intensity ratios makes it possible to set a target chromaticity point for the four blue LEDs 10B1 to 10B4 to, for example, an average chromaticity point P1 of the chromaticity points of the blue LEDs 10B1 to 10B4. In Example 1, a correction factor for shifting each measured chromaticity point of blue to the correction point P1 is determined by computation, and the luminance and the chromaticity of blue in an image signal are corrected with use of the correction factor. It is to be noted that the correction factor determined here is not limited to a correction factor for perfectly uniformizing luminance, and may include a correction factor that causes some luminance variation. As long as luminance variation is reduced to an acceptable image quality level, the luminance may not be necessarily perfectly uniform.

FIG. 16 schematically illustrates adjusted luminance and adjusted chromaticity (after shifting to the correction point P1) of blue outside the center of a retina in Example 1. FIG. 17 schematically illustrates vision of blue outside the center of the retina. Even in Example 1, as with Comparative Example 1, uniform blue is expressed in the pixels P11 to P14 outside the center of the retina (uniform blue is perceived).

FIG. 18 schematically illustrates adjusted luminance and adjusted chromaticity (after shifting to the correction point P1) of blue in the center of the retina in Example 1. FIG. 19 schematically illustrates vision of blue in the center of the retina. Since the center of the retina hardly perceives blue due to the foregoing reason, sensitivity to red and green is dominant. In Example 1, since the light emission intensity ratios of blue are adjusted to be uniform in the assembly U1, the intensity ratios of added red and added green are made uniform in the pixels (the color mixing ratios are made uniform). In other words, the color mixing ratios of R, G, and B are made uniform irrespective of wavelength variation between the blue LEDs 10B1 to 10B4. As a result, as schematically illustrated in FIGS. 18 and 19, uniform blue is expressed in the pixels P11 to P14 (uniform blue is perceived). In Example 1, even in the center of the retina, variation in brightness and hue of blue are less likely to be visually recognized.

It is to be noted that, since actual light emission intensity of blue varies between the pixels P11 to P14, the chromaticity of blue is not strictly uniform; however, since the density of the S cone cells is low and spatial resolution of blue is lower than those of red and green, variation in hue of blue between the pixels is less likely to be perceived. Moreover, it may be desirable that additive mixing be performed with use of the foregoing corrected luminance and the foregoing corrected chromaticity of blue to correct the luminances and the chromaticities of colors other than blue, i.e., red and green in each of the pixels.

(Effects)

As described above, in this embodiment, the correction factor determined by adjusting the light emission intensity ratios of the blue LEDs 10B1 to 10B4 provided in the assembly U1 including the pixels P11 to P14 is used to correct the luminance and the chromaticity of blue. The correction factor is determined, for example, by adding other primary colors (for example, red and green) by additive mixing; however, the light emission intensity ratios of blue are adjusted to treat the chromaticity of blue as a uniform value in the assembly U1. Since red and blue are added to uniform blue, the amounts of the added colors are uniform in the pixels P11 to P14. Variation in chromaticity that is easily visually recognized in the center of the retina of a human eye is reduced.

Moreover, as described above, the light emission intensity ratios of blue in the assembly U1 are adjusted to correct chromaticity, which makes it possible to set the chromaticity point of blue in a chromaticity diagram to a point outside the chromaticitiy point in Comparative Example 1. This makes it possible to enhance color reproducibility.

It is to be noted that these effects are larger with larger wavelength variation between the blue LEDs. Moreover, the M cone cells having sensitivity to green of photoreceptor cells are the second smallest in number next to the S cone cells. Therefore, when correction is performed not only in the blue LEDs but also in the green LEDs with use of the correction factor determined by adjusting the light emission intensity ratios in two or more pixels, this makes it possible to obtain an effect of improving image quality.

Other embodiments and modification examples of the disclosure will be described below. It is to be noted that like components are denoted by like numerals as of the foregoing first embodiment and will not be further described.

Second Embodiment

FIG. 20 is an example of a pixel array in a display section of a display apparatus according to a second embodiment of the disclosure. In the foregoing first embodiment, the light emission intensity ratios of blue are adjusted in the assemblies U1 in each of the display units Cn to correct luminance and chromaticity. In this embodiment, a correction factor is determined at least in each combination of adjacent display units Cn, and luminance and chromaticity is corrected with use of the determined correction factor.

More specifically, in this embodiment, as illustrated in FIG. 20, it is assumed that a blue LED 10B5 provided in each pixel P1 of a display unit C1 and a blue LED 10B6 provided in each pixel P2 of a display unit C2 are different in wavelength from each other. In the display units C1 and C2, the red LEDs 10R have an equal wavelength, and the green LEDs 10G have an equal wavelength.

In this embodiment, when variation in wavelength occurs between the blue LEDs of the display unit C1 and the blue LEDs 10B6 of the display unit C2, variation between brightness and hue occurs between the display units C1 and C2 to cause an influence, such as visual recognition of a boundary between the display units C1 and C2, on image quality. Accordingly, even in such a case, luminance and chromaticity caused by wavelength variation between the display units C1 and C2 are corrected.

A correction factor for luminance and chromaticity of blue according to a comparative example (Comparative Example 2) of this embodiment will be described below. In Comparative Example 2, it is assumed that the blue LEDs 10B5 and 10B6 having an extremely small difference in wavelength therebetween are provided. More specifically, the blue LED 10B5 has 460 nm, and the blue LED 10B6 has 462 nm.

In Comparative Example 2, after luminances and chromaticities in the display units C1 and C2 are measured, additive mixing of R, G, and B is performed. At this time, adjustment by the additive mixing is performed to have predetermined chromaticity and predetermined luminance in the entire display section 10. In principle, this makes it possible to adjust the chromaticity and the luminance in the entire display section (in all pixels) to be uniform.

When each pixel is corrected as with Comparative Example 2, respective chromaticity points of blue of the display units C1 and C2 may be adjusted to, for example, the correction point Pb illustrated in FIG. 21A. Accordingly, as illustrated in FIG. 21B, more green is additively mixed in the blue LED 10B5 with a relatively short wavelength, and more red is additively mixed in the blue LED 10B6 with a relatively long wavelength. As a result, as illustrated in FIGS. 22 and 23, outside the center of a retina, chromaticities of blue of the adjacent display units C1 and C2 are adjusted, and this makes it possible to express uniform blue. However, as illustrated in FIGS. 24 and 25, since it is difficult for the center of the retina to perceive blue due to the foregoing reason, the hue looks different between the display units C1 and C2. It is to be noted that, in FIG. 25, a difference in hue is schematically illustrated by a difference in hatching. A greenish tint and a reddish tint are visually recognized in the display unit C1 and the display unit C2, respectively, and a boundary between green and red is visible. The smaller a difference in wavelength between the blue LEDs 10B5 and 10B6 is, the more the amount of mixed red or green is decreased; however, since red and green have high sensitivity and high spatial resolution, a boundary between units is visually recognized. As a result, a boundary line by tiling is visually recognized to cause degradation in display quality, thereby easily causing, for example but not limited to, false recognition.

In this embodiment, luminance and chromaticity of blue are corrected with use of a correction factor determined by adjusting the light emission intensity ratios in at least adjacent display units Cn. More specifically, the correction factor is determined to allow the light emission intensity ratios of the blue LEDs 10B5 and 10B6 respectively provided in the adjacent display units C1 and C2 to have a uniform value. In other words, in the entire display section 10, the light emission intensity of blue is treated as uniform intensity, and the correction factor is determined. Herein, as with Comparative Example 2, the light emission wavelength of the blue LED 10B5 is 460 nm, and the light emission wavelength of the blue LED 10B6 is 462 nm.

Even in this embodiment, as with the foregoing Comparative Example 2, when the chromaticities of the LEDs of R, G, and B are plotted as illustrated in FIG. 26A, the chromaticity point of blue varies due to wavelength variation. In order to suppress variation in the chromaticity point to uniformize the chromaticity point, the intensity ratios of the red LEDs 10R and the green LEDs 10G are adjusted (additive mixing is performed). Unlike Comparative Example 2, in this embodiment, first, the light emission intensity ratios of the blue LEDs 10B5 and 10B6 are adjusted to be treated as a uniform value. In other words, as illustrated in FIG. 26B, the light emission intensity ratios of blue in the display units C1 and C2 are set to a uniform value, and the uniform blue is mixed with red and green. Moreover, in order to make luminance uniform in the display units C1 and C2, total luminance (a height in each graph in FIG. 26B) of R, G, and B is adjusted to be equal in the display units C1 and C2 while maintaining their light emission intensity ratios. Such adjustment of the light emission intensity ratios makes it possible to set a target chromaticity point for two blue LEDs 10B5 and 10B6 to, for example, an average chromaticity point P2 of the chromaticity points of the blue LEDs 10B5 and 10B6. In Example 2, a correction factor for shifting each measured chromaticity point of blue to the correction point P2 is determined by computation, and the luminance and the chromaticity of blue are corrected with use of the correction factor. Moreover, it may be desirable that additive mixing be performed with use of the foregoing corrected luminance and the foregoing corrected chromaticity of blue to correct the luminances and the chromaticities of colors other than blue, i.e., red and green in each of the pixels.

FIG. 27 schematically illustrates adjusted luminance and adjusted chromaticity (after shifting to the correction point P2) of blue outside the center of the retina in Example 2. FIG. 28 schematically illustrates vision of blue outside the center of the retina. Even in Example 2, as with Comparative Example 2, uniform blue is expressed in the display units C1 and C2 outside the center of the retina (uniform blue is perceived).

FIG. 29 schematically illustrates adjusted luminance and adjusted chromaticity (after shifting to the correction point P2) of blue in the center of the retina in Example 2. FIG. 30 schematically illustrates vision of blue in the center of the retina. Since the center of retina hardly perceives blue due to the foraging reason, sensitivity to red and green is dominant. In Example 2, since the light emission intensity ratios of blue are adjusted to be uniform in the display units C1 and C2, the intensity ratios of added red and added green are also made uniform in the display units C1 and C2 (the color mixing ratio is made uniform). In other words, the color mixing ratios of R, G, and B are made uniform irrespective of wavelength variation between the blue LEDs 10B5 and 10B6. As a result, as schematically illustrated in FIGS. 29 and 30, uniform blue is expressed in the display units C1 and C2 (uniform blue is perceived). Moreover, the boundary between the display units C1 and C2 is less likely to be visually recognized. It is to be noted that, since actual light emission intensity of blue varies between the display units C1 and C2, the chromaticity of blue is not strictly uniform; however, since the density of the S cone cells is low and spatial resolution of blue is lower than those of red and green, variation in hue of blue between the display units C1 and C2 is less likely to be visually recognized.

As with the foregoing first embodiment, this embodiment also makes it possible to improve image quality. Moreover, this embodiment makes it possible to enhance color reproductivity.

It is to be noted that, in a case where a difference in wavelength of blue between the display units C1 and C2 is extremely large, even though the foregoing technique is used, a difference in chromaticity of blue only may be visually recognized. At this time, whether or not the boundary is visible depends on a difference in the average wavelength between the display units C1 and C2 (variation between pixels is less likely to affect the boundary). In order to make the difference in blue only invisible, a difference in average wavelength between the display units C1 an C2 may be desirably about 4 nm or less, and more desirably about 2 nm or less. This applies to a difference between the assemblies U1 in the foregoing first embodiment. In order not to visually recognize a boundary between the assemblies U1, a difference in average wavelength between the assemblies U1 may be desirably about 4 nm or less, and more desirably about 2 nm or less.

Moreover, even in this embodiment, correction may be performed on not only the blue LEDs but also the green LEDs in a similar manner.

Further, the display units Cn may be formed adjacent to one another on a same substrate, or the display units Cn formed on different substrates from one another may be provided adjacent to one another. Furthermore, the display units Cn may be configured electrically independently of one another, or may be electrically connected to one another in part.

Third Embodiment

FIG. 31 is a chromaticity diagram for describing a correction factor used in a display apparatus according to a third embodiment of the disclosure. FIG. 32 is a chromaticity diagram for describing a correction factor according to a comparative example.

In this embodiment, in a case where blue LEDs that vary in wavelength between pixels or between display units are provided, luminance and chromaticity of blue are corrected. In this embodiment, the luminance of blue is corrected in each pixel. The chromaticity of blue is corrected with use of a correction factor determined, based on each of chromaticities of the blue LEDs in the assembly U1.

More specifically, as illustrated in FIG. 31, the chromaticity of blue is adjusted by determining an average value of the chromaticites of a pixel A corresponding to a long wavelength and a pixel B corresponding to a short wavelength and shifting chromaticity points of the pixels A and B to a target correction point P4 with use of a chromaticity point P3 of the average. A correction factor for shifting to the target correction point P4 is determined by computation, and chromaticity is corrected with use of the determined correction factor. Moreover, it may be desirable that additive mixing be performed with use of the foregoing corrected luminance and the foregoing corrected chromaticity of blue to correct the luminances and the chromaticities of colors other than blue, i.e., red and green in each of the pixels.

As illustrated in FIG. 32, in a comparative example (Comparative Example 3) of this embodiment, the luminance and the chromaticity of each pixel are collectively adjusted to shift each of the chromaticity points of the pixels A and B to a target correction point P5. In such Comparative Example 3, in a similar manner to that in this embodiment, an average of the chromaticities of the blue LEDs is determined, and a correction factor is determined with use of the average chromaticity. For example, in a case where other primary colors are added in each of the pixels by additive mixing, since cells perceiving respective primary colors are distributed in different positions on the retina of an eye, a phenomenon in which hues and brightness differ by the visual field easily occurs. Correction of the luminance and the chromaticity in this embodiment makes it possible to reduce the occurrence of such a phenomenon. This embodiment makes it possible to obtain similar effects to those in the foregoing first embodiment.

Modification Examples 1-1 to 1-7

FIGS. 33A to 33G illustrate other examples of the pixel array described in the foregoing first embodiment. Although a configuration in which the long wavelength group G1 and the short wavelength group G2 are provided in a staggered arrangement is exemplified as the assembly U1 configured of a 2'2-pixel region in the foregoing first embodiment (see FIG. 4), the assembly may have various configurations, and the long wavelength group G1 and the short wavelength group G2 may be arranged in various patterns.

For example, in Modification Example 1-1 illustrated in FIG. 33A, in an assembly U2 configured of a 2'3 (two rows by three columns)-pixel region, blue LEDs corresponding to wavelengths ($B_{13}$, $B_{21}$, and $B_{22}$) belonging to the long wavelength group G1 and blue LEDs corresponding to wavelengths ($B_{11}$, $B_{12}$, and $B_{23}$) belonging the short wavelength group G2 are provided. Moreover, in Modification Example 1-2 illustrated in FIG. 33B, in an assembly U3 configured of a 3'2 (three rows by two columns)-pixel region, blue LEDs corresponding to wavelengths ($B_{12}$, $B_{22}$, and $B_{31}$) belonging to the long wavelength group G1 and blue LEDs corresponding to wavelengths ($B_{11}$, $B_{21}$, and $B_{32}$) belonging the short wavelength group G2 are provided.

Further, in Modification Example 1-3 illustrated in FIG. 33C, in an assembly U4 configured of a 2'4 (two rows by four columns)-pixel region, blue LEDs corresponding to wavelengths ($B_{13}$, $B_{14}$, $B_{21}$, and $B_{22}$) belonging to the long wavelength group G1 and blue LEDs corresponding to wavelengths ($B_{11}$, $B_{12}$, $B_{23}$, and $B_{24}$) belonging the short wavelength group G2 are provided. Furthermore, in Modification Example 1-4 illustrated in FIG. 33D, in an assembly U5 configured of a 4'2 (four rows by two columns)-pixel region, blue LEDs corresponding to wavelengths ($B_{12}$, $B_{22}$, $B_{31}$, and $B_{41}$) belonging to the long wavelength group G1 and blue LEDs corresponding to wavelengths ($B_{11}$, $B_{21}$, $B_{32}$, and $B_{42}$) belonging the short wavelength group G2 are provided.

In addition, in Modification Example 1-5 illustrated in FIG. 33E, in an assembly U6 configured of a 2'5 (two rows by five columns)-pixel region, blue LEDs corresponding to wavelengths ($B_{12}$, $B_{14}$, $B_{15}$, $B_{21}$, and $B_{23}$) belonging to the long wavelength group G1 and blue LEDs corresponding to wavelengths ($B_{11}$, $B_{14}$, $B_{22}$, $B_{24}$, and $B_{25}$) belonging the short wavelength group G2 are provided. Moreover, in Modification Example 1-6 illustrated in FIG. 33F, in an assembly U7 configured of a 5'2 (five rows by two columns)-pixel region, blue LEDs corresponding to wavelengths ($B_{11}$, $B_{22}$, $B_{31}$, $B_{42}$, and $B_{52}$) belonging to the long wavelength group G1 and blue LEDs corresponding to wavelengths ($B_{12}$, $B_{21}$, $B_{32}$, $B_{41}$, and $B_{51}$) belonging the short wavelength group G2 are provided.

Further, in Modification Example 1-7 illustrated in FIG. 33G, in an assembly U8 configured of a 4'4 (four rows by four columns)-pixel region, blue LEDs corresponding to wavelengths ($B_{13}$, $B_{14}$, $B_{23}$, $B_{24}$, $B_{31}$, $B_{32}$, $B_{41}$, and $B_{42}$) belonging to the long wavelength group G1 and blue LEDs corresponding to wavelengths ($B_{11}$, $B_{12}$, $B_{21}$, $B_{22}$, $B_{33}$, $B_{34}$, $B_{43}$, and $B_{44}$) belonging the short wavelength group G2 are provided.

It may be only necessary to appropriately disperse and mix the blue LEDs corresponding to the wavelengths belonging to the long wavelength group G1 and the blue LEDs corresponding to the wavelengths belonging to the short wavelength group G2. For example, the blue LEDs corresponding to the wavelengths belonging to the long wavelength group G1 and the blue LEDs corresponding to the wavelengths belonging to the short wavelength group G2 may be alternately provided along a row direction, a column direction, or an oblique direction. Moreover, in the foregoing embodiments and the foregoing modification examples, configurations in which the blue LEDs corresponding to the wavelengths belonging to the long wavelength group G1 and the blue LEDs corresponding to the wavelengths belonging to the short wavelength group G2 are periodically repeatedly provided are exemplified; however, they may not be necessarily provided with regularity. In other words, the blue LEDs corresponding to the wavelengths belonging to the long wavelength group G1 and the blue LEDs corresponding to the wavelengths belonging to the short wavelength group G2 may be randomly provided.

Although the disclosure is described referring to the embodiments and the modification examples, the disclosure is not limited thereto, and may be variously modified. For example, in the foregoing embodiments and the foregoing modification examples, a case where LEDs of the three primary colors R, G, and B are provided as light-emitting devices of an embodiment of the disclosure is described as an example; however, LEDs of any other color may be provided. In other words, the disclosure is applicable to LED displays of four or more colors. Moreover, LEDs of any other color may be included instead of one of the LEDs of R, G, and B.

Further, in the foregoing embodiments and the forgoing modification examples, the LEDs are exemplified as the light-emitting devices of the embodiment of the disclosure; however, the disclosure may be widely applicable to displays using, as an active layer, any other light-emitting devices, for example, organic electroluminescence devices or quantum dots. The disclosure is specifically effective for a display using light-emitting devices that largely vary in chromaticity of a single color.

It is to be noted that the disclosure may have the following configurations.

(1)

A display apparatus including:

a display section including a plurality of pixels, each of the pixels including light-emitting devices of a plurality of primary colors; and a drive section configured to drive the plurality of pixels, based on an inputted image signal, the drive section correcting luminance and chromaticity of a first primary color of the plurality of primary colors with use of a correction factor that is determined by adjusting light emission intensity ratios of light-emitting devices of the first primary color provided in two or more of the pixels.

(2)

The display apparatus according to (1), in which the display section includes, as unit arrays, assemblies including two or more adjacent pixels of the pixels, the light-emitting devices of the first primary color in each of the assemblies vary in light emission wavelength according pixel positions, and the correction factor is determined in each of the assemblies.

(3)

The display apparatus according to (2), in which the correction factor is determined assuming that the light emission intensity ratios of the light-emitting devices of the first primary color provided in the assembly have a uniform value.

(4)

The display apparatus according to (1), in which the display section is configured of two or more display units being two-dimensionally arranged, each of the display units including the plurality of pixels, the light-emitting devices of the first primary color vary in light emission wavelength between the display units, and the correction factor is determined in at least each combination of adjacent display units of the two or more display units.

(5)

The display apparatus according to (4), in which the correction factor is determined assuming that the light emission intensity ratios of the light-emitting devices of the first primary color provided in the adjacent display units have a uniform value.

(6)

The display apparatus according to any one of (1) to (5), in which the drive section performs additive mixing with use of corrected luminance and corrected chromaticity of the first primary color to correct, in each of the pixels, luminances and chromaticities of colors other than the first primary color included in the image signal.

(7)

The display apparatus according to any one of (1) to (6), in which the light-emitting devices of the first primary color vary in light emission wavelength according to pixel positions in the display section, and a difference in wavelength between a light-emitting device of the first primary color corresponding to the longest wavelength and a light-emitting device of the first primary color corresponding to the shortest wavelength of the light-emitting devices of the first primary color is about 10 nm or more.

(8)

The display apparatus according to (2) or (3), in which a difference in average wavelength between the assemblies is about 4 nm or less.

(9)

The display apparatus according to (2) or (3), in which a difference in average wavelength between the assemblies is about 2 nm or less.

(10)

The display apparatus according to (4) or (5), in which a difference in average wavelength between the display units is about 4 nm or less.

(11)

The display apparatus according to (4) or (5), in which a difference in average wavelength between the display units is about 2 nm or less.

(12)

The display apparatus according to any one of (1) to (11), in which light-emitting devices corresponding to a wavelength belonging to a relatively long wavelength group and light-emitting devices corresponding to a wavelength belonging to a relatively short wavelength group of the light-emitting devices of the first primary color are alternately provided along a row direction, a column direction, or an oblique direction.

(13)

The display apparatus according to any one of (1) to (12), in which each of the pixels includes light-emitting devices of red, green, and blue, and the first primary color is blue.

(14)

The display apparatus according to (13), in which the light-emitting device of the first primary color includes an AlGaInN-based light-emitting diode.

(15)

The display apparatus according to (13) or (14), in which the drive section corrects luminance and chromaticity of green with use of a correction factor determined by adjusting light emission intensity ratios of the light-emitting devices of green provided in two or more of the pixels.

(16)

A display apparatus including:

a display section including a plurality of pixels, each of the pixels including light-emitting devices of a plurality of primary colors; and a drive section configured to drive the plurality of pixels, based on an inputted image signal, the drive section correcting luminance of a first primary color of the plurality of primary colors in each of the pixels, and correcting chromaticity of the first primary color with use of a correction factor that is determined, based on chromaticities of the light-emitting devices of the first primary color provided in two or more of the pixels.

(17)

The display apparatus according to (16), in which the drive section performs additive mixing with use of corrected luminance and corrected chromaticity of the first primary color in each of the pixels to correct, in each of the pixels, luminances and chromaticities of colors other than the first primary color.

(18)

A correction method including:

determining a correction factor upon correcting of luminances and chromaticities of light-emitting devices of a plurality of primary colors provided in each of pixels of a display section, the correction factor being determined by adjusting light emission intensity ratios of light-emitting devices of a first primary color of the plurality of primary colors provided in two or more of the pixels; and correcting luminance and chromaticity of the first primary color with use of the determined correction factor.

(19)

A correction method including:

correcting, upon correcting of luminances of light-emitting devices of a plurality of primary colors provided in each of pixels of a display section, luminance of a first primary color in each of the pixels; and correcting, upon correcting of chromaticities of the light-emitting devices of the plurality of primary colors, chromaticity of the first primary color with use of a correction factor that is determined, based on chromaticities of the light-emitting devices of the first primary color provided in two or more of the pixels.

(20)

A display apparatus including:

a display section comprising a plurality of display units arranged in a two-dimensional array, wherein each of the display units comprises a plurality of pixels arranged in a matrix, and each of the plurality pixels comprises a plurality of light-emitting devices that are each configured to emit a different color of light; and circuitry configured to generate a corrected image signal based on an uncorrected image signal and correction factors that correct luminance and chromaticity of the light-emitting devices, including at least some correction factors determined by adjusting light emission intensity ratios of first light-emitting devices that are configured to emit light of a particular color and are disposed in different ones of the plurality of pixels.

(21)

The display apparatus according to (20), wherein each of the display units comprises a unit array of pixel assemblies that each comprises a plurality of adjacent pixels, the first light-emitting devices vary in light emission wavelength according to pixel positions, and at least one of the correction factors is determined for each of the pixel assemblies by adjusting light emission intensity ratios of the first light-emitting devices disposed in different pixels.

(22)

The display apparatus according to (21), wherein the correction factor for each of the pixel assemblies is determined by performing a calculation in which the light emission intensity ratios of the first light-emitting devices in that pixel assembly are assumed to have a uniform value.

(23)

The display apparatus according to any one of (20) to (22), wherein the first light-emitting devices vary in light emission wavelength between the display units, and at least one of the correction factors is determined for at least each combination of adjacent display units of the plurality display units.

(24)

The display apparatus according to (23), wherein the at least one correction factor for each combination of adjacent display units is determined by performing a calculation in which the light emission intensity ratios of the first light-emitting devices in that combination of adjacent display units are assumed to have a uniform value.

(25)

The display apparatus according to any one of (20) to (24), wherein the circuitry is configured to generate the corrected image signal by performing additive mixing with use of corrected luminance and corrected chromaticity of the particular color to correct, for each of the pixels, luminances and chromaticities of colors other than the particular color included in the image signal.

(26)

The display apparatus according to any one of (20) to (25), wherein the first light-emitting devices vary in light emission wavelength according to pixel positions in the display section, and a difference in wavelength between a first light-emitting device corresponding to a longest wavelength and a first light-emitting device corresponding to a shortest wavelength of the first light-emitting devices is about 10 nm or more.

(27)

The display apparatus according to any one of (20) to (26), wherein a difference in average wavelength between the pixel assemblies is about 4 nm or less.

(28)

The display apparatus according to any one of (20) to (27), wherein a difference in average wavelength between the pixel assemblies is about 2 nm or less.

(29)

The display apparatus according to any one of (23), wherein a difference in average wavelength between the display units is about 4 nm or less.

(30)

The display apparatus according to any one of (23), wherein a difference in average wavelength between the display units is about 2 nm or less.

(31)

The display apparatus according to any one of (20) to (30), wherein first light-emitting devices corresponding to a wavelength belonging to a relatively long wavelength group and first light-emitting devices corresponding to a wavelength belonging to a relatively short wavelength group are alternately provided along a row direction, a column direction, or an oblique direction.

(32)

The display apparatus according to any one of (20) to (30), wherein each of the plurality of pixels includes a light-emitting device configured to emit red light, a light-emitting device configured to emit green light, and a light-emitting device configured to emit blue, light and the particular color is blue.

(33)

The display apparatus according (32), wherein the light-emitting device configured to emit blue light comprises an AlGaInN-based light-emitting diode.

(34)

The display apparatus according to (32) or (33), wherein the circuitry is configured to generate the corrected image signal to correct luminance and chromaticity of green with use of correction factors determined by adjusting light emission intensity ratios of the light-emitting devices that are configured to emit green light and are disposed in different pixels.

(35)

A display apparatus including:

a display section comprising a plurality of display units arranged in a two-dimensional array, wherein each of the display units comprises a plurality of pixels arranged in a matrix, and each of the plurality pixels comprises a plurality of light-emitting devices that are each configured to emit a different color of light; and circuitry configured to generate a corrected image signal based on an uncorrected image signal and correction factors that correct luminance and chromaticity of the light-emitting devices, including at least some correction factors determined by correcting luminance of first light-emitting devices that emit light of a particular color, and determining correction factors for correcting chromaticities of the first light emitting devices based on chromaticities of the luminance-corrected first light-emitting devices that are disposed in different pixels.

(36)

The display apparatus according to (35), wherein the circuitry is configured to generate the corrected image signal by performing additive mixing with use of corrected luminance and corrected chromaticity of the particular color to correct, for each of the pixels, luminances and chromaticities of colors other than the particular color included in the image signal.

(38)

A method for use with a display apparatus including a plurality of display units arranged in a two-dimensional array, wherein each of the display units comprises a plurality of pixels arranged in a matrix, and each of the plurality pixels comprises a plurality of light-emitting devices that are each configured to emit a different color of light, the method comprising:

determining correction factors for correcting luminance and chromaticity of each of the light-emitting devices by adjusting light emission intensity ratios of first light-emitting devices that are configured to emit light of a particular color and are disposed in different ones of the plurality of pixels.

(39)

The method according to (38), further including:

storing the correction factors in memory of the display apparatus so as to be accessible to circuitry of the display apparatus that is configured to drive the plurality of pixels based on a corrected image signal that is generated based on an inputted image signal and the stored correction factors.

(40)

The method according to (38) or (39), further including:

generating a corrected image signal based on an inputted image signal and the stored correction factors; and providing the corrected image signal to a drive circuit configured to drive the plurality of pixels based on the corrected image signal.

(41)

The method according to any one of (38) to (40), wherein, at least one of the correction factors is determined for each of pixel assemblies that each comprises a plurality of adjacent pixels by adjusting light emission intensity ratios of the first light-emitting devices disposed in different pixels.

(42)

The method according to (41), wherein the correction factor for each of the pixel assemblies is determined by performing a calculation in which the light emission intensity ratios of the first light-emitting devices in that pixel assembly are assumed to have a uniform value.

(43)

The method according to any one of (38) to (42), wherein at least one of the correction factors is determined for at least each combination of adjacent display units of the plurality display units.

(44)

The method of according to (43), wherein the at least one correction factor for each combination of adjacent display units is determined by performing a calculation in which the light emission intensity ratios of the first light-emitting devices in that combination of adjacent display units are assumed to have a uniform value.

(45)

The method according to any one of (38) to (44), wherein the particular color is blue.

(46)

A method for use with a display apparatus including a plurality of display units arranged in a two-dimensional array, wherein each of the display units comprises a plurality of pixels arranged in a matrix, and each of the plurality pixels comprises a plurality of light-emitting devices that are each configured to emit a different color of light, the method comprising:

determining correction factors for correcting luminance and chromaticity of each of the light-emitting devices by (a) correcting luminance of first light-emitting devices that emit light of a particular color, and (b) determining correction factors for correcting chromaticities of the first light emitting devices based on chromaticities of the luminance-corrected first light-emitting devices that are disposed in different pixels.

(47)

The method according to (46), further including:

storing the correction factors in memory of the display apparatus so as to be accessible to circuitry of the display apparatus that is configured to drive the plurality of pixels based on a corrected image signal that is generated based on an inputted image signal and the stored correction factors.

(48)

The method according to (46) or (47), further including:

generating a corrected image signal based on an inputted image signal and the stored correction factors; and providing the corrected image signal to a drive circuit configured to drive the plurality of pixels based on the corrected image signal.

It should be understood by those skilled in the art that various modifications, combinations, sub-combinations, and alterations may occur depending on design requirements and other factors insofar as they are within the scope of the appended claims or the equivalents thereof.

REFERENCE SIGNS LIST

1 display apparatus
1A display system
10 display section
10B1 to 10B6 blue LED
10R red LED
10G green LED
20 drive section
30 control section
31 correction processing section
40 correction factor obtaining section
41 camera
42 luminance-chromaticity measurement section
43 computation processing section
44 storage section
Cn, C1, C2 display unit
U1 to U8 assembly

The invention claimed is:

1. A display apparatus, comprising:

a display section comprising a plurality of display units arranged in a two-dimensional array, wherein each of the display units comprises a plurality of pixels arranged in a matrix, and each of the plurality pixels comprises a plurality of light-emitting devices that each emit a different color of light; and circuitry configured to generate a corrected image signal based on an uncorrected image signal and correction factors that correct luminance and chromaticity of the light-emitting devices, including correction factors determined by adjusting light emission intensity ratios of first light-emitting devices that emit light of a particular color and are disposed in different ones of the plurality of pixels, wherein each of the display units comprises a unit array of pixel assemblies that each comprises a plurality of adjacent pixels, the first light-emitting devices vary in light emission wavelength according to pixel positions, at least one of the correction factors is determined for each of the pixel assemblies by adjusting light emission intensity ratios of the first light-emitting devices disposed in different pixels, and the correction factor for each of the pixel assemblies is determined by performing a calculation in which the light emission intensity ratios of the first light-emitting devices in that pixel assembly are assumed to have a uniform value.

2. The display apparatus according to claim 1, wherein the first light-emitting devices vary in light emission wavelength between the display units, and at least one of the correction factors is determined for at least each combination of adjacent display units of the plurality display units.

3. The display apparatus according to claim 2, wherein the at least one correction factor for each combination of adjacent display units is determined by performing a calculation in which the light emission intensity ratios of the first light-emitting devices in that combination of adjacent display units are assumed to have a uniform value.

4. The display apparatus according to claim 2, wherein a difference in average wavelength between the display units is about 4 nm or less.

5. The display apparatus according to claim 2, wherein a difference in average wavelength between the display units is about 2 nm or less.

6. The display apparatus according to claim 1, wherein the circuitry is configured to generate the corrected image signal by performing additive mixing with use of corrected luminance and corrected chromaticity of the particular color to correct, for each of the pixels, luminances and chromaticities of colors other than the particular color included in the image signal.

7. The display apparatus according to claim 1, wherein the first light-emitting devices vary in light emission wavelength according to pixel positions in the display section, and a difference in wavelength between a first light-emitting device corresponding to a longest wavelength and a first light-emitting device corresponding to a shortest wavelength of the first light-emitting devices is about 10 nm or more.

8. The display apparatus according to claim 1, wherein a difference in average wavelength between the pixel assemblies is about 4 nm or less.

9. The display apparatus according to claim 1, wherein a difference in average wavelength between the pixel assemblies is about 2 nm or less.

10. The display apparatus according to claim 1, wherein first light-emitting devices corresponding to a wavelength belonging to a relatively long wavelength group and first light-emitting devices corresponding to a wavelength belonging to a relatively short wavelength group are alternately provided along a row direction, a column direction, or an oblique direction.

11. The display apparatus according to claim 1, wherein each of the plurality of pixels includes a light-emitting device that emits red light, a light-emitting device that emits green light, and a light-emitting device that emits blue, light and the particular color is blue.

12. The display apparatus according to claim 11, wherein the light-emitting device that emits blue light comprises an AlGaInN-based light-emitting diode.

13. The display apparatus according to claim 11, wherein the circuitry is configured to generate the corrected image signal to correct luminance and chromaticity of green with use of correction factors determined by adjusting light emission intensity ratios of the light-emitting devices that emit green light and are disposed in different pixels.

14. A method for use with a display apparatus comprising a plurality of display units arranged in a two-dimensional array, wherein each of the display units comprises a plurality of pixels arranged in a matrix, and each of the plurality pixels comprises a plurality of light-emitting devices that each emit a different color of light, the method comprising:

determining correction factors for correcting luminance and chromaticity of each of the light-emitting devices by adjusting light emission intensity ratios of first light-emitting devices that emit light of a particular color and are disposed in different ones of the plurality of pixels, wherein at least one of the correction factors is determined for each of pixel assemblies that each comprises a plurality of adjacent pixels by adjusting light emission intensity ratios of the first light-emitting devices disposed in different pixels, and wherein the correction factor for each of the pixel assemblies is determined by performing a calculation in which the light emission intensity ratios of the first light-emitting devices in that pixel assembly are assumed to have a uniform value.

15. The method of claim 14, further comprising:

storing the correction factors in memory of the display apparatus so as to be accessible to circuitry of the display apparatus that is configured to drive the plurality of pixels based on a corrected image signal that is generated based on an inputted image signal and the stored correction factors.

16. The method of claim 14, further comprising:

generating a corrected image signal based on an inputted image signal and the stored correction factors; and providing the corrected image signal to a drive circuit configured to drive the plurality of pixels based on the corrected image signal.

17. The method of claim 14, wherein at least one of the correction factors is determined for at least each combination of adjacent display units of the plurality display units.

18. The method of claim 17, wherein the at least one correction factor for each combination of adjacent display units is determined by performing a calculation in which the light emission intensity ratios of the first light-emitting devices in that combination of adjacent display units are assumed to have a uniform value.

19. The method of claim 14, wherein the particular color is blue.

* * * * *